US011090945B2

(12) United States Patent
Ochiai et al.

(10) Patent No.: US 11,090,945 B2
(45) Date of Patent: Aug. 17, 2021

(54) LIQUID DISCHARGE APPARATUS

(71) Applicant: SEIKO EPSON CORPORATION, Tokyo (JP)

(72) Inventors: Toshiyuki Ochiai, Shiojiri (JP); Hideki Okumura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/799,122

(22) Filed: Feb. 24, 2020

(65) Prior Publication Data

US 2020/0269596 A1 Aug. 27, 2020

(30) Foreign Application Priority Data

Feb. 25, 2019 (JP) ..... JP2019-031340

(51) Int. Cl.

| | |
|---|---|
| ***B41J 2/175*** | (2006.01) |
| ***B41J 29/02*** | (2006.01) |
| ***B41J 29/38*** | (2006.01) |
| ***B41J 29/13*** | (2006.01) |

(52) U.S. Cl.

CPC ..... *B41J 2/17596* (2013.01); *B41J 2/17509* (2013.01); *B41J 29/02* (2013.01); *B41J 29/13* (2013.01); *B41J 29/38* (2013.01)

(58) Field of Classification Search

CPC .... B41J 2/175; B41J 2/17509; B41J 2/17596; B41J 29/02; B41J 29/13; B41J 29/38

See application file for complete search history.

(56) References Cited

U.S. PATENT DOCUMENTS

| | | | | |
|---|---|---|---|---|
| 6,042,216 | A * | 3/2000 | Garcia | B41J 2/1652 347/29 |
| 6,478,415 | B2 * | 11/2002 | Barinaga | B41J 2/175 347/85 |
| 6,908,180 | B2 * | 6/2005 | Dietl | B41J 2/175 347/85 |
| 9,421,781 | B2 * | 8/2016 | Kimura | B41J 2/20 |
| 2017/0120617 | A1 | 5/2017 | Matsumura et al. | |
| 2019/0039383 | A1 | 2/2019 | Matsumura et al. | |

FOREIGN PATENT DOCUMENTS

| | | |
|---|---|---|
| JP | 2006-068994 | 3/2006 |
| JP | 2014-188929 | 10/2014 |
| JP | 2015-024527 | 2/2015 |
| JP | 2015-134485 | 7/2015 |
| JP | 2017-081121 | 5/2017 |

* cited by examiner

*Primary Examiner* — Anh T Vo
(74) *Attorney, Agent, or Firm* — Workman Nydegger

(57) ABSTRACT

A liquid discharge apparatus includes a liquid storing portion, a liquid discharge unit that discharges the liquid to a medium and performs printing, a supply flow path that communicates the liquid storing portion and the liquid discharge unit, an opening/closing mechanism including an opening/closing unit that brings the supply flow path into an open state or a closed state and an operation unit that operates the opening/closing unit, and a moving unit configured to move between a first position that is a normal position when performing the printing and a second position different from the first position. A range where the operation unit brings supply flow path into a transient state between the open state and the closed state includes a position of the operation unit at which the operation unit interferes with the moving unit located in the first position.

10 Claims, 9 Drawing Sheets

LIQUID DISCHARGE APPARATUS

The present application is based on, and claims priority from JP Application Serial Number 2019-031340, filed Feb. 25, 2019, the disclosure of which is hereby incorporated by reference herein in its entirety.

BACKGROUND

1. Technical Field

The present disclosure relates to a liquid discharge apparatus.

2. Related Art

JP-A-2015-134485 discloses a liquid discharge apparatus that discharges ink from a liquid discharge unit and performs printing. An ink supply apparatus included in the liquid discharge apparatus supplies ink retained in a tank to the liquid discharge unit through a supply flow path. An opening/closing mechanism included in the ink supply apparatus switches the supply flow path to an open state and a closed state when an operation knob is rotated by a hand. The supply flow path in the open state enables processing that requires supply of liquid. The supply flow path in the closed state enables processing that requires stop of the supply of liquid.

On the other hand, when the operation knob is stopped in a transient state between the open state and the closed state, the liquid can be supplied at a flow rate smaller than that in the open state. As a result, a required processing result is difficult to be obtained in both the processing that requires supply of liquid and the processing that requires stop of the supply of liquid.

SUMMARY

According to an aspect of the present disclosure, a liquid discharge apparatus includes a liquid storing portion that stores liquid, a liquid discharge unit that discharges the liquid to a medium and performs printing, a supply flow path that communicates the liquid storing portion and the liquid discharge unit, an opening/closing mechanism including an opening/closing unit that brings the supply flow path into an open state or a closed state and an operation unit that operates the opening/closing unit, and a moving unit configured to move between a first position that is a normal position when performing printing and a second position different from the first position. A range where the operation unit brings the supply flow path into a transient state between the open state and the closed state includes a position of the operation unit at which the operation unit interferes with the moving unit located in the first position.

DESCRIPTION OF EXEMPLARY EMBODIMENTS

Figure 1:
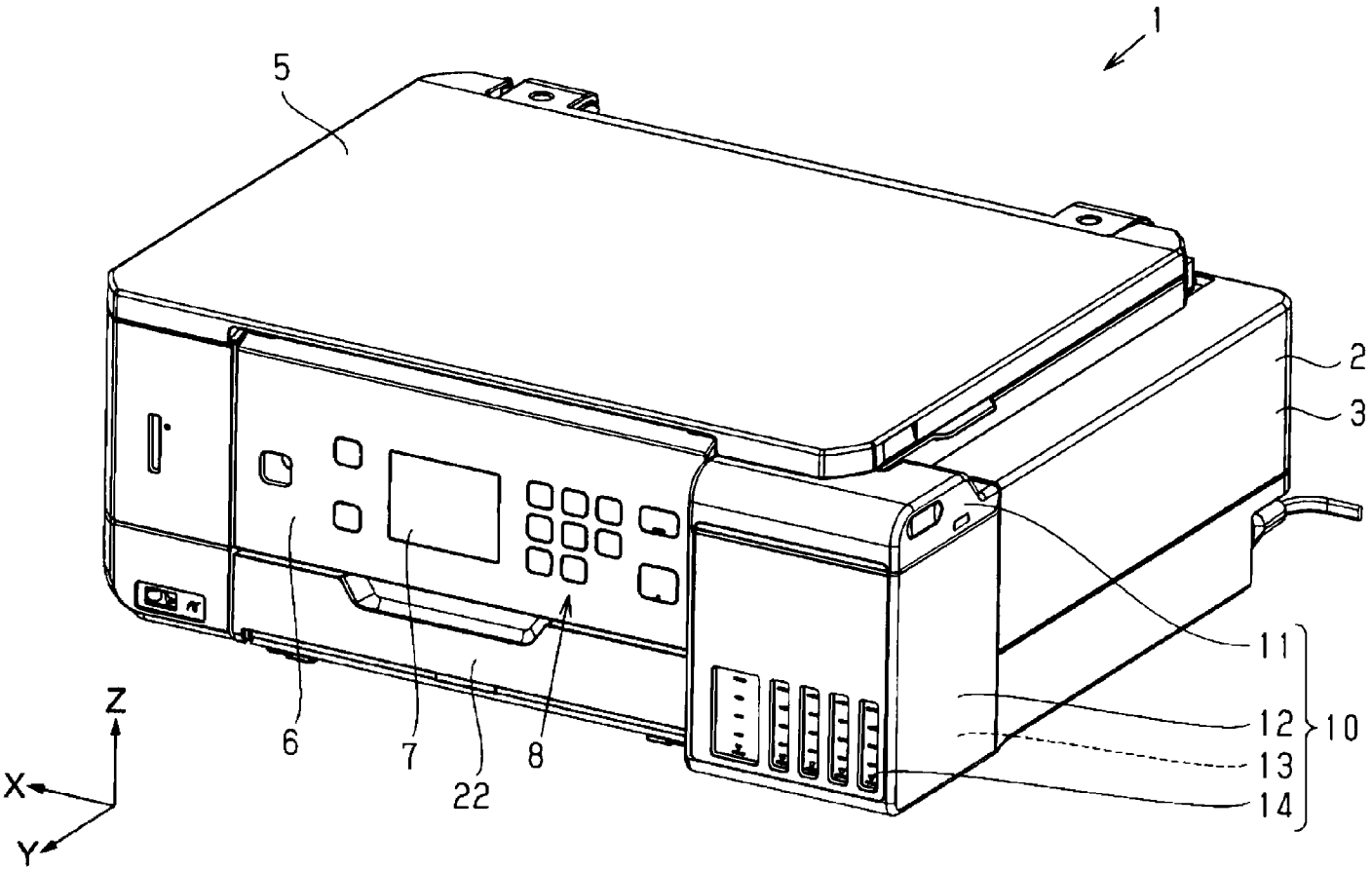
FIG. 1 is a perspective view of a liquid discharge apparatus in an embodiment.

An embodiment of a liquid discharge apparatus will be described with reference to FIGS. 1 to 12. In the description below, a configuration of the liquid discharge apparatus, a configuration of an opening/closing mechanism, an interference between an operation unit and a moving unit, a configuration of a control unit and a first contact portion, a detection method of an open/close state of a supply flow path, and a configuration of a restricting portion will be described sequentially. The liquid discharge apparatus in the present embodiment is, for example, an ink jet type printer that performs printing by discharging ink, which is an example of a liquid, to a medium such as a paper sheet. In the drawings below, the scale of each member is differentiated from the actual one in order to show each member in a recognizable size.

In the description below, the liquid discharge apparatus is assumed to be placed on a horizontal surface, a vertical direction is represented by Z axis, and directions along a horizontal surface perpendicular to the vertical direction are represented by X axis and Y axis. The X axis, the Y axis, and the Z axis are perpendicular to each other. In the description below, a direction along the X axis is also called a width direction X, a direction along the Y axis is also called a depth direction Y, and a direction along the Z axis is also called a vertical direction Z. The width direction X, the depth direction Y, and the vertical direction Z are orthogonal to each other. One end side in the width direction of the liquid discharge apparatus is called a right side surface side or a right side, and the other end side opposite to the one end side may be called a left side surface side or a left side. One end side in the depth direction Y of the liquid discharge apparatus is called a front surface side or a front side, and the other end side opposite to the one end side may be called a back surface side or a back side. One end side in the vertical direction Z of the liquid discharge apparatus is called an upper surface side or an upper side, and the other end side opposite to the one end side may be called a lower surface side or a lower side.

Configuration of Liquid Discharge Apparatus

Figure 2:
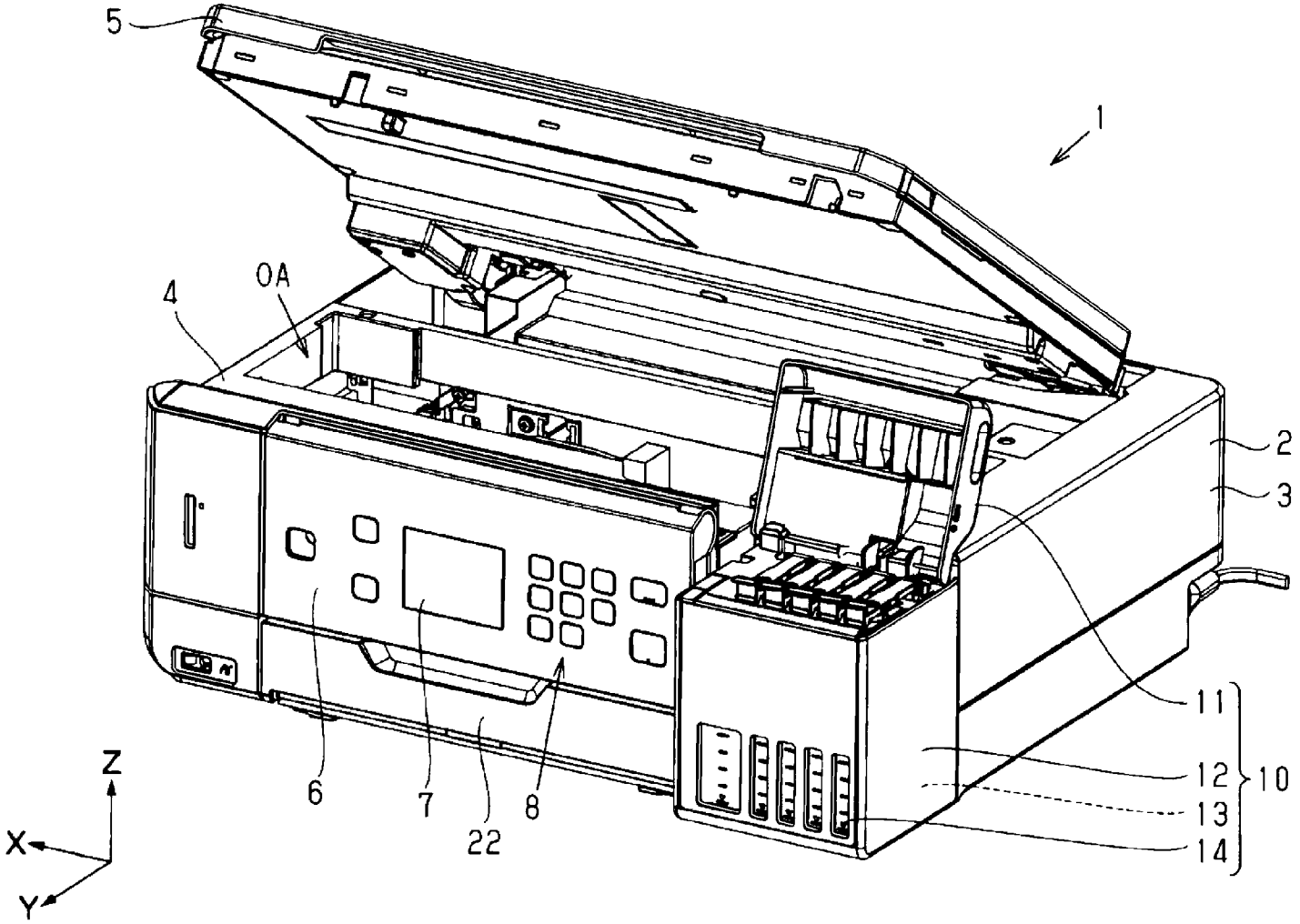
FIG. 2 is a perspective view of the liquid discharge apparatus in the embodiment.

A schematic configuration of the liquid discharge apparatus in the present embodiment will be described with reference to FIGS. 1 and 2. FIG. 1 is a perspective view of a liquid discharge apparatus 1, where an apparatus main body 2 is closed, as viewed from the front and above. FIG. 2 is a perspective view of the liquid discharge apparatus 1, where the apparatus main body 2 is opened, as viewed from the front and above of the apparatus.

As shown in FIG. 1, the liquid discharge apparatus 1 includes the apparatus main body 2 and a scanner 5.

The apparatus main body 2 includes a housing 3 that is an exterior frame, an operation panel 6, and a liquid reservoir unit 10. The housing 3 includes a frame 4 framing an opening OA. The opening OA allows a user to access inside the apparatus main body 2.

The operation panel 6 forms a part of the front surface of the apparatus main body 2. The operation panel 6 includes a display unit 7 such as a liquid crystal panel, and operation buttons 8 including an input button, a power supply switch, and the like. The operation panel 6 is linked to the housing 3 rotatably around an upper end portion of the operation panel 6. The operation panel 6 is an example of a notification unit.

The apparatus main body 2 stores a medium ejection tray not shown in the drawings. The medium ejection tray is stored in the apparatus main body 2 movably in the depth direction Y. The medium ejection tray moves forward and backward between a position where the medium ejection tray is stored in the apparatus main body 2 and a position where the medium ejection tray is pulled out frontward from the apparatus main body 2. The medium ejection tray is exposed in front of the apparatus main body 2 when the operation panel 6 is rotated.

The scanner 5 is located over the apparatus main body 2 so as to be able to cover the opening OA from above. The scanner 5 is an example of the moving unit. The scanner 5 is linked to the apparatus main body 2 rotatably around a rear end portion of the scanner 5. The scanner 5 rotates in a range between a first position and a second position. The range where the scanner 5 rotates includes the first position and the second position. In FIG. 1, scanner 5 is arranged in the first position. In FIG. 2, scanner 5 is arranged in the second position.

The first position is a position where the scanner 5 convers the opening OA. The second position is a position where the scanner 5 opens the interior of the apparatus main body 2. In other words, the scanner 5 closes the opening OA in the first position and opens the opening OA in the second position. The first position is a normal position of the scanner 5 when the liquid discharge apparatus 1 performs printing. The second position is a normal position of the scanner 5 when the inside of the apparatus main body 2 is repaired.

The liquid discharge apparatus 1 may have a configuration not including the scanner 5. In the configuration not including the scanner 5, the liquid discharge apparatus 1 includes a cover moving between a position where the cover covers the opening OA and a position where the cover opens the interior of the apparatus main body 2. The cover is an example of the moving unit.

The liquid reservoir unit 10 is located under the scanner 5 at the front right end of the scanner 5 in the first position. The liquid reservoir unit 10 includes liquid storing portions 13 that retain ink, a storage case 12 that stores the liquid storing portion 13, and a unit cover 11 rotatably attached to the storage case 12.

The liquid reservoir unit 10 includes a plurality of liquid storing portions 13. Each liquid storing portion 13 retains one type of ink selected from black, magenta, yellow, cyan, and photo black inks. A volume of the ink that can be stored in each liquid storing portion 13 may be equal to a volume of the ink that can be stored in another liquid storing portion 13 or may be different from a volume of the ink that can be stored in another liquid storing portion 13. The liquid storing portion 13 includes a display portion 14. The display portion 14 makes a remaining amount of ink in the liquid storing portion 13 recognizable from outside.

The liquid discharge apparatus 1 includes a medium storage unit 22 that can store media. The medium storage unit 22 is located under the operation panel 6. The medium storage unit 22 enables insertion and removal for performing replenishment and removal of media in front of the apparatus main body 2.

Figure 3:
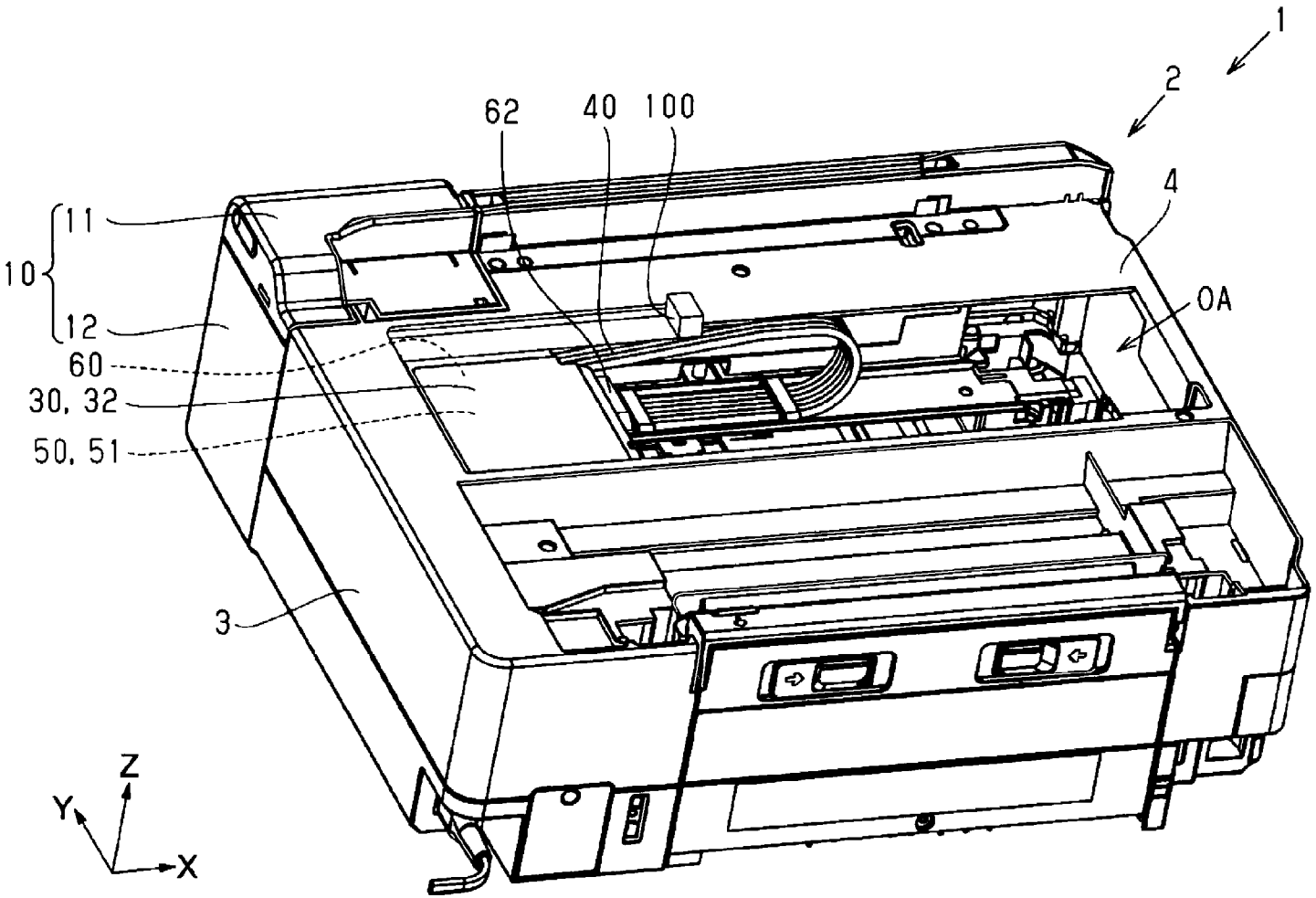
FIG. 3 is a perspective view of the liquid discharge apparatus from which a scanner is removed in the embodiment.

An internal configuration of the liquid discharge apparatus will be described with reference to FIG. 3. FIG. 3 is a perspective view of the liquid discharge apparatus 1, from which the scanner 5 is removed, as viewed from above and rear.

As shown in FIG. 3, the apparatus main body 2 includes a carriage 30, a supply flow path 40, a liquid discharge unit 50, and an opening/closing mechanism 60.

The carriage 30 is housed inside the housing 3. The carriage 30 reciprocates along the width direction X. One direction of the directions in which the carriage 30 reciprocates is a first direction, and a direction opposite to the first direction is a second direction. The first direction is also called a main scanning direction.

The carriage 30 is a hollow container. The carriage 30 includes a carriage cover 32 over the carriage 30 in the vertical direction Z. The carriage 30 is mounted with the liquid discharge unit 50 and the opening/closing mechanism 60. The liquid discharge unit 50 is attached to a lower portion of the carriage 30. The opening/closing mechanism 60 is attached to an upper portion of the carriage 30.

The supply flow path 40 causes the liquid storing portion 13 and the liquid discharge unit 50 to be able to communicate with each other. The ink retained in the liquid storing portion 13 is supplied to the liquid discharge unit 50 through the supply flow path 40. The supply flow path 40 transits between an open state and a closed state by the opening/closing mechanism 60. The supply flow path 40 also has a transient state between the open state and the closed state.

The open state of the states of the supply flow path 40 is a state in which the flow rate of ink required for printing can be supplied to the liquid discharge unit 50. The state in which the flow rate of ink required for printing can be supplied to the liquid discharge unit 50 is, for example, a state in which a part of the supply flow path 40 is crushed to the extent that the flow rate of ink required for printing can be flowed or a state in which the supply flow path 40 is not crushed.

The closed state of the states of the supply flow path 40 is a state in which ink cannot be supplied to the liquid discharge unit 50. The state in which ink cannot be supplied to the liquid discharge unit 50 is a state in which a part of the supply flow path 40 is crushed and closed. The state in which ink cannot be supplied to the liquid discharge unit 50 includes a state in which a part of the supply flow path 40 is crushed to the extent that ink leakage does not occur in the liquid discharge unit 50 and the like even when the liquid discharge apparatus 1 receives vibrations during transportation and the like.

The transient state is all the states of the supply flow path 40 except for the open state and the closed state and is a state between the open state and the closed state. For example, the transient state may include a state in which the supply flow path 40 can supply ink at a flow rate smaller than that in the open state. The transient state may include a state in which the supply flow path 40 can supply ink at a flow rate greater than that in the closed state. The transient state may include a state in which the flow rate of ink is more unstable than in the open state and the closed state.

The liquid discharge unit 50 includes a pressure generation chamber not shown in the drawings, piezoelectric elements not shown in the drawings, and a plurality of nozzles 51. The pressure generation chamber includes a vibration plate not shown in the drawings. The piezoelectric element generates pressure variation in the pressure generation chamber by vibrating the vibration plate.

The plurality of nozzles 51 are located on a lower surface of the liquid discharge unit 50. The lower surface of the liquid discharge unit 50 is a nozzle surface where the plurality of nozzles 51 are located. For example, the plurality of nozzles 51 are arranged along the depth direction Y and constitute a nozzle array.

Each nozzle 51 is communicated with a relay adaptor not shown in the drawings through a flow path not shown in the drawings included in the pressure generation chamber and the liquid discharge unit 50. The relay adaptor is a container that temporarily retains ink. A plurality of relay adaptors are mounted inside the carriage 30 and covered by the carriage cover 32. The plurality of relay adaptors can communicate with the liquid storing portion 13 through the supply flow path 40. The ink retained in the liquid storing portion 13 is supplied to the liquid discharge unit 50 through the supply flow path 40 and the relay adaptors.

When the liquid discharge apparatus 1 performs printing, the plurality of nozzles 51 are arranged so as to face a medium. The piezoelectric element generates pressure variation in the pressure generation chamber and discharges ink supplied from the supply flow path 40 to the medium from the nozzle 51. In the present embodiment, a direction in which the liquid discharge unit 50 discharges ink is along the vertical direction Z.

Configuration of Opening/Closing Mechanism

Figure 4:
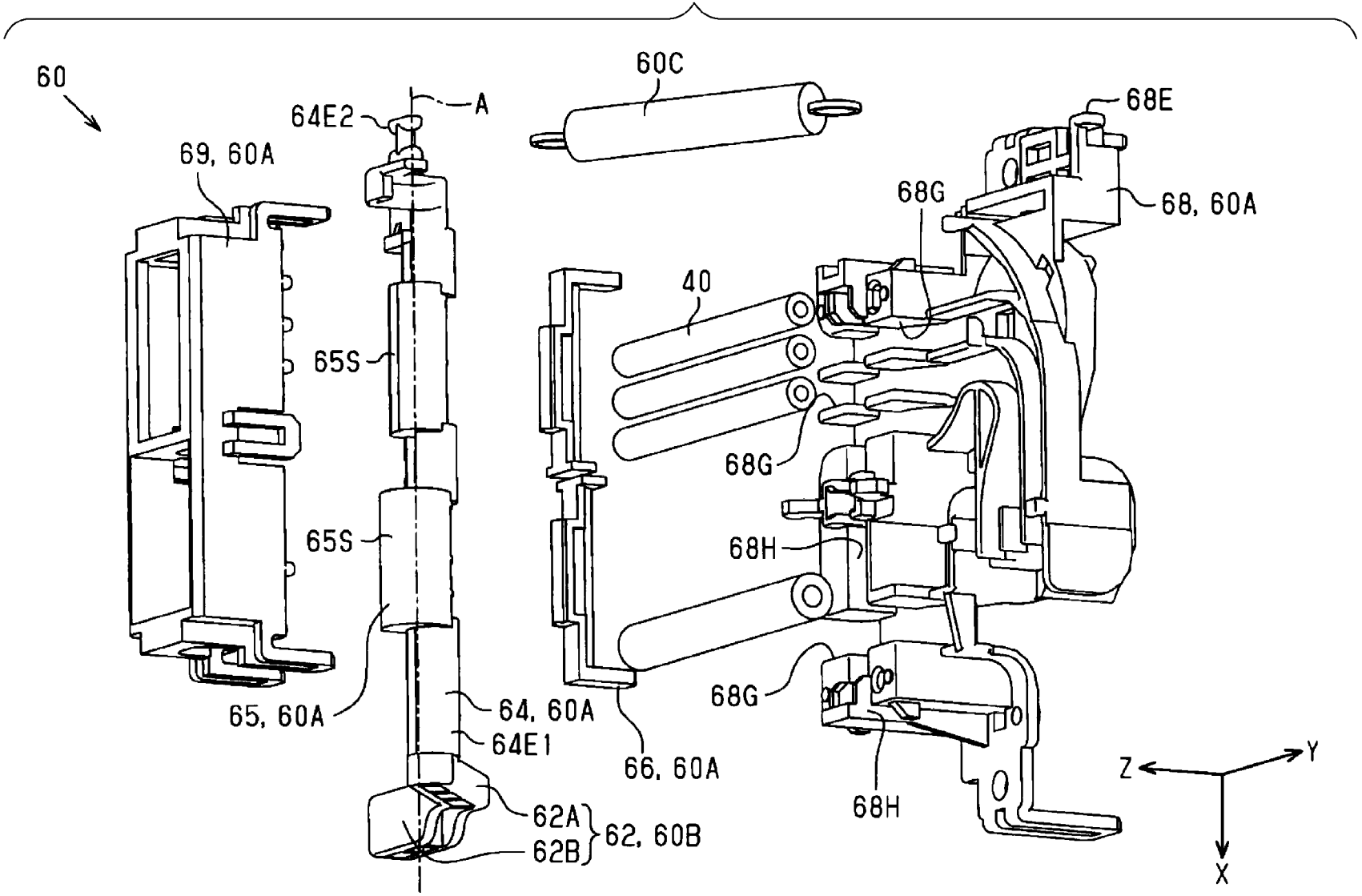
FIG. 4 is an exploded perspective view of an opening/closing mechanism included in the liquid discharge apparatus in the embodiment.

The opening/closing mechanism will be described with reference to FIG. 4. FIG. 4 is an exploded perspective view of the opening/closing mechanism 60 included in the liquid discharge apparatus 1.

As shown in FIG. 4, the opening/closing mechanism 60 includes an opening/closing unit 60A that switches the supply flow path 40 to the open state and the closed state, an operation unit 60B that operates the opening/closing unit 60A, and an energizing member 60C that energizes the operation unit 60B.

The opening/closing unit 60A includes a shaft unit 64, a cam unit 65, a pressing member 66, and a supply flow path support unit 68, and a case 69. The supply flow path support unit 68 and the case 69 are an exterior frame of the opening/closing mechanism 60. Between the supply flow path support unit 68 and the case 69, the pressing member 66, the cam unit 65, and the shaft unit 64 are arranged in order from the supply flow path support unit 68 along the vertical direction Z. Each supply flow path 40 is located between the pressing member 66 and the supply flow path support unit 68. The case 69 is located higher than the supply flow path support unit 68 in a state in which the opening/closing mechanism 60 is mounted on the carriage 30.

The supply flow path support unit 68 is provided with a plurality of grooves 68G. The plurality of grooves 68G extend along the depth direction Y and are arranged side by side along the width direction X. One supply flow path 40 is inserted into each groove 68G. The supply flow paths 40 are arranged side by side along the width direction X.

The supply flow path support unit 68 is provided with a recessed portion 68H. The recessed portion 68H is a depressed portion along the vertical direction Z. The recessed portion 68H extends along the width direction X so as to penetrate all the plurality of grooves 68G in the width direction X.

The pressing member 66 traverses over all the supply flow paths 40 arranged side by side along the width direction X. The pressing member 66 is inserted into the recessed portion 68H. The pressing member 66 and a bottom portion of the recessed portion 68H sandwich the supply flow paths 40 inserted into the grooves 68G in the vertical direction Z.

The pressing member 66 is housed in the supply flow path support unit 68 movably along the vertical direction Z. Walls that form the recessed portion 68H guide the pressing member 66 to move along the vertical direction Z. The pressing member 66 can move toward the bottom portion of the recessed portion 68H and can move toward the opening of the recessed portion 68H.

The pressing member 66 increases pressure to the supply flow path 40 by the movement toward the bottom portion of the recessed portion 68H. The pressing member 66 decreases pressure to the supply flow path 40 by the movement toward the opening of the recessed portion 68H. When the pressure to the supply flow path 40 is increased, the supply flow path 40 transits from the open state to the closed state. When the pressure to the supply flow path 40 is decreased, the supply flow path 40 transits from the closed state to the open state.

The shaft unit 64 extends in the width direction X. The shaft unit 64 is located over the pressing member 66 over the entire pressing member 66 in the width direction X. The shaft unit 64 is mounted on the carriage 30 so as to be able to rotate in a first rotation direction around a rotation center that is a rotation axis A and rotate in a second rotation direction opposite to the first rotation direction. In a state in which the opening/closing mechanism 60 is mounted on the carriage 30, the rotation axis A of the shaft unit 64 is arranged along the width direction X and the shaft unit 64 is supported by the case 69 so as not to move in the vertical direction Z. One end portion in the X direction of the shaft unit 64 is integrated with the operation unit 60B.

The cam unit 65 extends along the width direction X. The cam unit 65 has a length corresponding to a length of all the plurality of supply flow paths 40 along the width direction X. The cam unit 65 is integrated with the shaft unit 64 and rotates interlocking with the rotation of the shaft unit 64. In a state in which the opening/closing mechanism 60 is mounted on the carriage 30, the cam unit 65 is located over the pressing member 66.

A cam surface 65S of the cam unit 65 is an outer circumferential surface of the cam unit 65 and is a cylindrical surface extending along the width direction X. While the rotation center of the cam unit 65 is the rotation axis A of the shaft unit 64, the center of the cam surface 65S is different from the rotation axis A of the shaft unit 64. The center of the cam surface 65S is located on an outer side in a radial direction of the rotation axis A. In other words, the center of the cam surface 65S of the cam unit 65 is eccentric from the rotation axis A of the shaft unit 64. In a state in which the opening/closing mechanism 60 is mounted on the carriage 30, a part of the cam surface 65S is in contact with the pressing member 66 so as to press the pressing member 66 downward.

In the present embodiment, the opening/closing mechanism 60 has two cam units 65 arranged side by side along the width direction X. However, the number of the cam units 65 may be one or two or more as long as the cam unit(s) 65 have a length of all the plurality of supply flow paths 40. The cam surface 65S of the cam unit 65 is a cylindrical surface extending along the width direction X. However, the cam surface 65S may be an elliptic cylindrical surface extending along the width direction X or may have an infinite form other than the cylindrical surface and the elliptic cylindrical surface as long as the cam unit 65 has a cam surface that changes a position of the pressing member 66 in the vertical direction Z interlocking with the rotation of the shaft unit 64.

The operation unit 60B includes a lever 62. The lever 62 includes a base portion 62A and a tip portion 62B. The base portion 62A is integrated with an end portion 64E1 of the shaft unit 64 and extends in a radial direction of the shaft unit 64 from the end portion 64E1 of the shaft unit 64 to the tip portion 62B. The lever 62 bends at a boundary between the base portion 62A and the tip portion 62B.

The lever 62 is located in a plane orthogonal to the rotation axis A. The lever 62 is mounted on the carriage 30 rotatably around the rotation axis A. The lever 62 is rotated in the first rotation direction or the second rotation direction by, for example, fingers of a user. A rotational force acting on the lever 62 rotates the shaft unit 64, and thereby the cam unit 65 is rotated. The rotation of the cam unit 65 causes the supply flow path 40 to transit from the open state to the closed state or causes the supply flow path 40 to transit from the closed state to the open state.

The rotation of the lever 62 includes a closing motion that tilts the tip portion 62B toward the front and an opening motion that tilts the tip portion 62B toward the rear by using the end portion 64E1 of the shaft unit 64 as a fulcrum.

A movable range of the lever 62 is a range of a relative position of the lever 62 with respect to the opening/closing unit 60A. The movable range of the lever 62 is between an end position to which the lever 62 reaches when the lever 62 is opened and an end position to which the lever 62 reaches when the lever 62 is closed. The movable range of the lever 62 includes an open position where the supply flow path 40 is brought into the open state and a closed position where the supply flow path 40 is brought into the closed state. The movable range of the lever 62 includes a transient position between the open position and the closed position. The movable range of the lever 62 is an example of a movable range of the operation unit.

The energizing member 60C is a coil spring extending in one direction or an elastic body such as a rubber member. In the present embodiment, one end portion 64E1 in the width direction X of the shaft unit 64 is integrated with the lever 62, and the other end portion 64E2 in the width direction X of the shaft unit 64 is coupled to one end portion of the energizing member 60C. The other end portion of the energizing member 60C is hooked to a hooking portion 68E of the supply flow path support unit 68.

An energizing force outputted from the energizing member 60C is transmitted to the end portion 64E2 of the shaft unit 64 and acts so as to pull downward the tip portion 62B of the lever 62. For example, when the tip portion 62B of the lever 62 is located on the front side of the shaft unit 64, the energizing force outputted from the energizing member 60C energizes the lever 62 toward the closed position. When the tip portion 62B of the lever 62 is located on the back side of the shaft unit 64, the energizing force outputted from the energizing member 60C energizes the lever 62 toward the open position.

The case 69 is configured to be engageable with the supply flow path support unit 68. The case 69 covers the shaft unit 64, the pressing member 66, and the cam unit 65 from above in the vertical direction Z. The shaft unit 64, the pressing member 66, and the cam unit 65 are protected by the case 69 and the supply flow path support unit 68. The lever 62 and the energizing member 60C are exposed to the outside of the case 69 and the supply flow path support unit 68.

Movable Range of Operation Unit

Figure 5:
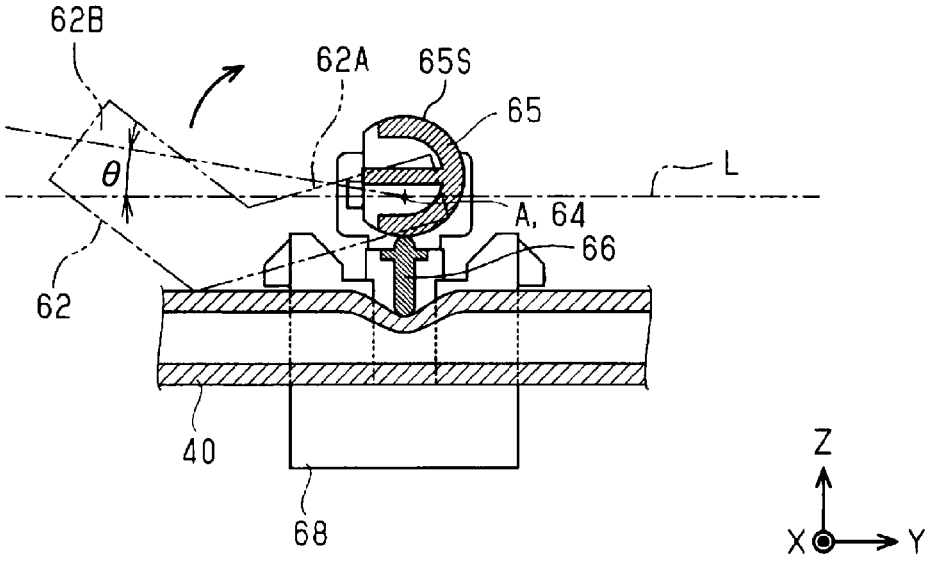
FIG. 5 is a cross-sectional view of the opening/closing mechanism when a supply flow path is in an open state in the embodiment.
Figure 6:
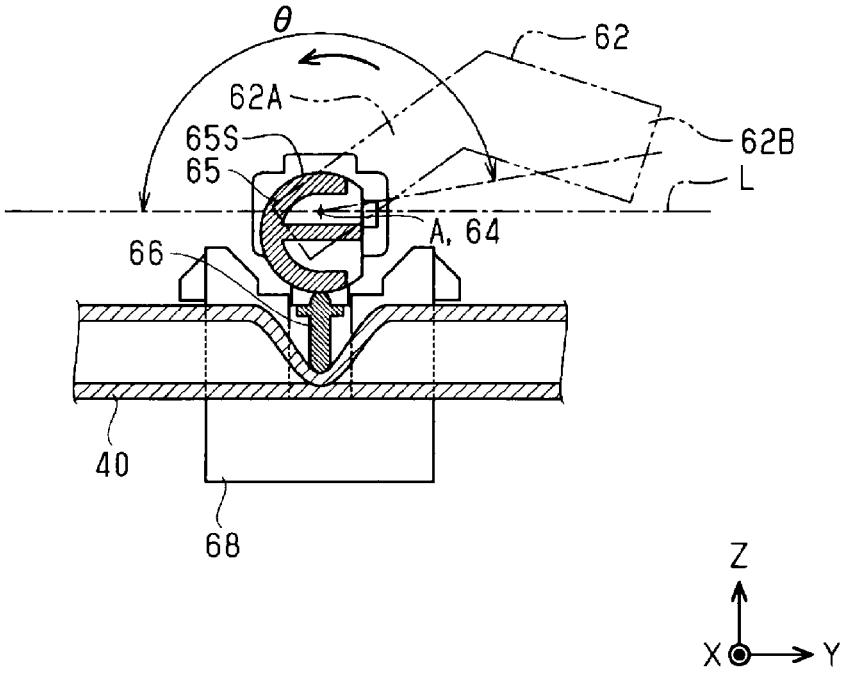
FIG. 6 is a cross-sectional view of the opening/closing mechanism when the supply flow path is in a closed state in the embodiment.

FIGS. 5 and 6 are diagrams schematically showing a cross-section of the opening/closing mechanism 60 as viewed from the width direction X. In FIGS. 5 and 6, the case 69 is omitted, a structure of the opening/closing unit 60A on a deep side of a paper surface of FIGS. 5 and 6 is shown by solid lines, and the lever 6 on a front side of the paper surface of FIGS. 5 and 6 is shown by two-dot chain lines. In FIG. 5, the position of the lever 62 is the open position, and the supply flow path 40 is in the open state. In FIG. 6, the position of the lever 62 is the closed position, and the supply flow path 40 is in the closed state. For convenience of description of an operation angle θ, FIG. 5 shows an open position different from the end position to which the lever 62 reaches when the lever 62 is opened and FIG. 6 shows an open position different from the end position to which the lever 62 reaches when the lever 62 is closed.

The cam surface 65S of the cam unit 65 rotates interlocking with the rotation of the shaft unit 64. The center of the cam surface 65S is eccentric from the rotation axis A, so that a distance between a position on the cam surface 65S in contact with the pressing member 66 and the rotation axis A of the shaft unit 64 changes interlocking with the rotation of the shaft unit 64. In other words, the center of the cam surface 65S is eccentric from the rotation axis A, so that a position in the vertical direction Z of the pressing member 66 changes interlocking with the rotation of the shaft unit 64.

At the end position to which the lever 62 reaches when the lever 62 is opened, the operation angle θ of the lever 62 is a minimum operation angle that has a smallest value. At the end position to which the lever 62 reaches when the lever 62 is closed, the operation angle θ of the lever 62 is a maximum operation angle that has a greatest value. The maximum operation angle is, for example, 180°.

As shown in FIG. 5, the operation angle θ of the lever 62 is a center angle centering the rotation axis A, which is defined by a straight line connecting a base end and a front end of the lever 62 and the rotation axis A. The minimum operation angle θ is 0°. The operation angle θ may be defined as an angle formed by the straight line connecting the base end and the front end of the lever 62 and a reference line L which is a straight line passing through the rotation axis A of the shaft unit 64 and extending along the depth direction Y.

The movable range of the lever 62 is between the end position to which the lever 62 reaches when the lever 62 is opened and the end position to which the lever 62 reaches when the lever 62 is closed. The end position to which the lever 62 reaches when the lever 62 is opened is included in the open position. The end position to which the lever 62 reaches when the lever 62 is closed is included in the closed position.

The open position is a position of the lever 62 that brings the supply flow path 40 into the open state. The open state is a state in which the flow rate of ink required for printing can be supplied to the liquid discharge unit 50. Therefore, the open position may be only the end position to which the lever 62 reaches when the lever 62 is opened or may be a certain range including the end position to which the lever 62 reaches when the lever 62 is opened. That is, the operation angle θ in the open position may be the minimum operation angle or may be a range including the minimum operation angle and angles other than the minimum operation angle. The range including the minimum operation angle and angles other than the minimum operation angle is, for example, a range from 0° to 10°.

The closed position is a position of the lever 62 that brings the supply flow path 40 into the closed state. The closed state is a state in which ink cannot be supplied to the liquid discharge unit 50. Therefore, the closed position may be only the end position to which the lever 62 reaches when the lever 62 is closed or may be a certain range including the end position to which the lever 62 reaches when the lever 62 is closed. That is, the operation angle θ in the closed position may be the maximum operation angle or may be a range including the maximum operation angle and angles other than the maximum operation angle. The range including the maximum operation angle and angles other than the maximum operation angle is, for example, a range from 140° to 180°.

The transient position is a position of the lever 62 that brings the supply flow path 40 into the transient state. The transient position is a range where the open position and the closed position are removed from the movable range of the lever 62. That is, the operation angle θ in the transient position is a range where the operation angle θ in the open position and the operation angle θ in the closed position are removed from the entire operation angle. The operation angle θ in the transient position is, for example, between 10° and 140°.

When the lever 62 is located in the open position, the pressing member 66 sufficiently opens the supply flow path 40. When the lever 62 is located in the closed position, the pressing member 66 presses the supply flow path 40 and sufficiently closes the supply flow path 40. When the lever 62 is located in the transient position, the pressing member 66 presses the supply flow path 40 so as to insufficiently open the supply flow path 40 or insufficiently close the supply flow path 40.

Here, as shown in FIG. 5, when the lever 62 is located in the open position and the supply flow path 40 is in the open state, the tip portion 62B is rotated upward and forward. Specifically, the lever 62 located in the open position is rotated in a direction indicated by an arrow in FIG. 5. Thereby, the lever 62 moves to the transient position and the pressing member 66 comes close to a lower portion of the supply flow path support unit 68 and begins to crush the supply flow path 40.

Subsequently, when the tip portion 62B is rotated forward and downward, the position of the pressing member 66 further changes downward. Thereby, as shown in FIG. 6, the lever 62 reaches the closed position and the supply flow path 40 is crushed by pressure between the pressing member 66 and the lower portion of the supply flow path support unit 68. Then, a communication between the liquid storing portion 13 and the liquid discharge unit 50 is blocked and the supply flow path 40 transits to the closed state.

On the other hand, when the lever 62 is located in the closed position and the supply flow path 40 is in the closed state, the tip portion 62B is rotated upward and backward. Specifically, the lever 62 located in the closed position is rotated in a direction indicated by an arrow in FIG. 6. Thereby, the lever 62 returns to the transient position, the pressing member 66 comes away from the lower portion of the supply flow path support unit 68, and the crush of the supply flow path 40 is alleviated.

Subsequently, when the tip portion 62B is rotated backward and downward, the position of the pressing member 66 further changes upward. Thereby, as shown in FIG. 5, the lever 62 returns to the open position and the supply flow path 40 transits to the open state.

The energizing member 60C energizes downward the tip portion 62B of the lever 62. Specifically, the energizing member 60C energizes the lever 62 toward the open position when the lever 62 is located in the transient position close to the open position. The energizing member 60C energizes the lever 62 toward the closed position when the lever 62 is located in the transient position close to the closed position.

The pressing member 66 receives a frictional force between the pressing member 66 and the supply flow path 40, a reaction force of the supply flow path 40 against the pressure from the pressing member 66 and the like. The frictional force and the reaction force received by the pressing member 66 are also a restraining force that stops the rotation of the lever 62. Although the energizing force outputted from the energizing member 60C is smaller than the restraining force acting on the lever 62, the energizing force is a force resisting against the restraining force. Therefore, the lever 62 close to the open position is energized toward the open position and accordingly the lever 62 can be restrained from stopping in the transient position. Further, the lever 62 close to the closed position is energized toward the closed position and accordingly the lever 62 can be restrained from stopping in the transient position. Thereby, it is possible to suppress supply of ink that is supplied because the lever 62 stops in the transient position, and the liquid discharge apparatus 1 can suppress consumption of ink that is not intended by a user.

Interference Between Operation Unit and Moving Unit

Figure 7:
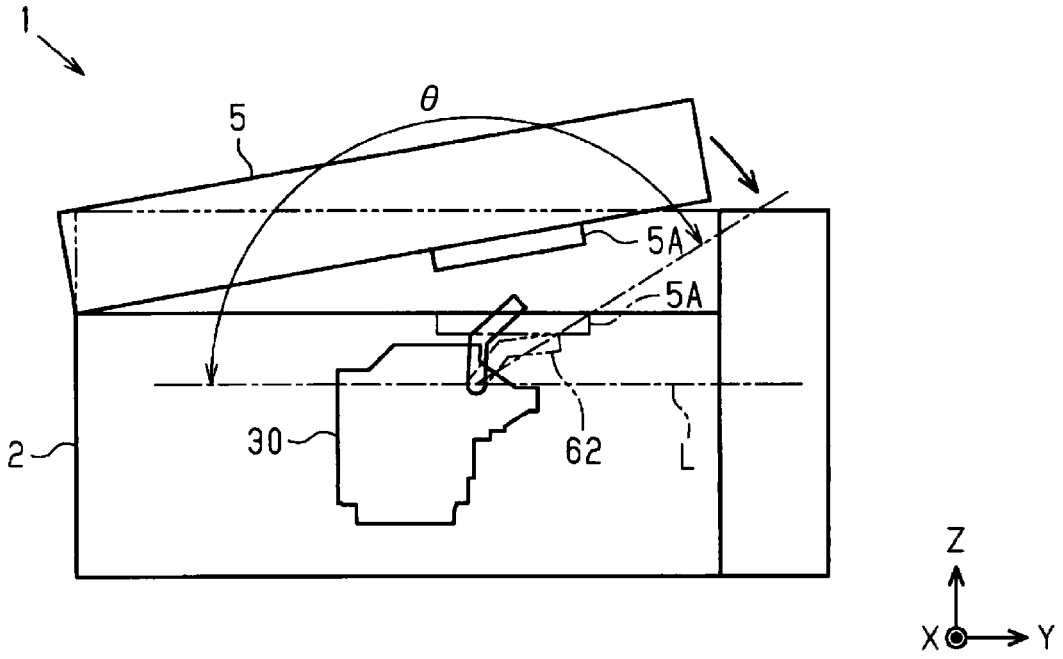
FIG. 7 is a side view of the liquid discharge apparatus showing a transition of a lever in a transient state in the embodiment.
Figure 8:
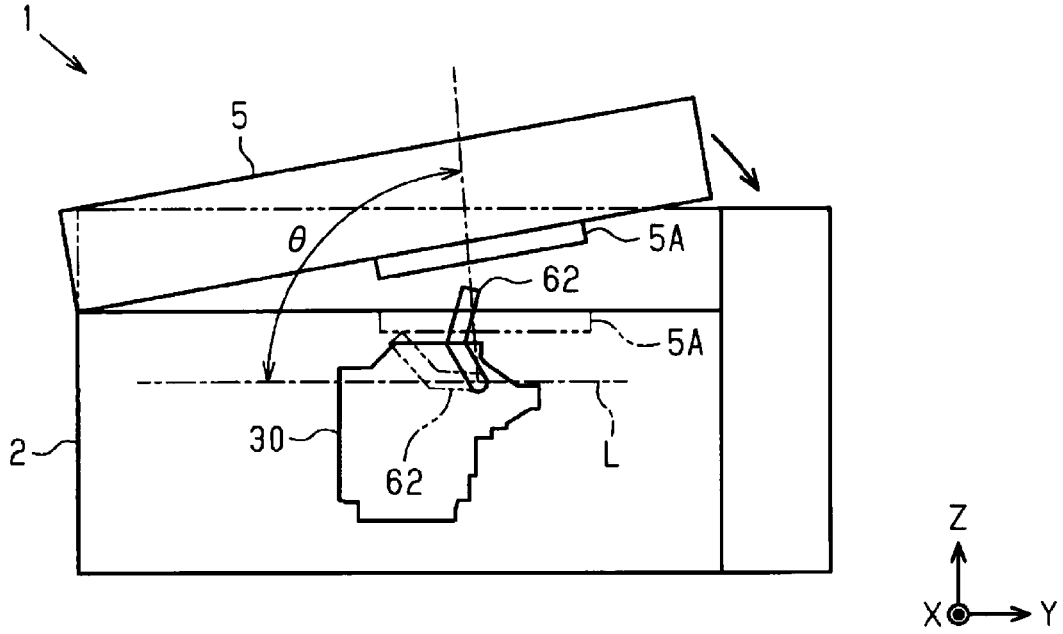
FIG. 8 is a side view of the liquid discharge apparatus showing a transition of the lever in the transient state in the embodiment.

FIGS. 7 and 8 are side views of the liquid discharge apparatus 1 as viewed from the left side surface. FIGS. 7 and 8 are views showing a transition where the scanner 5 moves from the second position to the first position and are views where the positions of the lever 62 are different from each other. In FIGS. 7 and 8, the scanner 5, the lever 62, and the carriage 30 included in the apparatus main body 2 are schematically shown, and the other components are omitted.

As shown in FIG. 7, a lower surface of the scanner 5 includes a rib 5A. The rib 5A has a shape protruding downward from the lower surface of the scanner 5. The rib 5A extends along the depth direction Y. The rib 5A is located immediately above the lever 62 in a state in which the scanner 5 is located in the first position. The rib 5A may be located above the lever 62 in a position where the liquid discharge unit 50 does not face the medium or may be located above the lever 62 in a position where the liquid discharge unit 50 faces the medium. The rib 5A may be located above the lever 62 over the entire range in which the carriage 30 moves in the width direction X. In the present embodiment, an example will be described in which the rib 5A is located immediately above the lever 62 in a state in which the carriage 30 is located at a home position HP, that is, a state in which the liquid discharge unit 50 is located in a position where the liquid discharge unit 50 does not face the medium.

The rib 5A has a shape that may interfere with the lever 62 located in the transient position located below the rib 5A in a state in which the scanner 5 closes the apparatus main body 2. The rib 5A has a shape that does not interfere with the lever 62 located in the closed position or the open position located below the rib 5A in the state in which the scanner 5 closes the apparatus main body 2. For example, the rib 5A has a height where the rib 5A does not interfere with the lever 62 located in the closed position or the open position and the rib 5A does not raise the scanner 5 in the state in which the scanner 5 closes the apparatus main body 2. A lower surface of the rib 5A may be a flat surface or may be a curved surface.

In the movable range of the lever 62, a range in which the supply flow path 40 is brought into the transient state is the transient position. The transient position of the lever 62 includes a position where the lever 62 interferes with the rib 5A of the scanner 5 located in the first position. The position of the lever 62 that interferes with the rib 5A may be the entire transient position, may be a part of the transient position, or may be a position including at least one of a part of the open position and a part of the closed position in addition to the transient position. The operation angle θ in the position of the lever 62 that interferes with the rib 5A is, for example, in a range from 40° to 80° and a range from 100° to 170°.

Here, as shown by solid lines in FIG. 7, the lever 62 is located closer to the closed position than to the middle between the open position and the closed position. From this state, when the scanner 5 moves from the second position to the first position, the rib 5A interferes with the lever 62 located under the rib 5A. The lever 62 which is located closer to the closed position and interferes with the rib 5A is pushed by the scanner 5 moving to the first position and moved so as to be close to the closed position. As a result, as shown by two-dot chain lines in FIG. 7, the lever 62, which is located closer to the closed position and which is located in the transient position, moves toward the closed position. The lever 62 that moves toward the closed position easily moves to the end position, to which the lever 62 reaches when the lever 62 is closed, by being energized by the energizing member 60C.

When the liquid discharge apparatus 1 is transported, if the supply flow path 40 is closed, ink hardly leaks from the nozzles 51 of the liquid discharge unit 50. Specifically, when the liquid discharge apparatus 1 is transported, vibrations and shocks are applied to the ink in the liquid storing portion 13 and the supply flow path 40. When the vibrations and shocks are applied to the ink in the liquid storing portion 13 and the supply flow path 40, pressure is applied to the ink in the nozzles 51 of the liquid discharge unit 50, so there is a risk that the ink leaks from the nozzles 51 of the liquid discharge unit 50. In this regard, if the scanner 5 is moved to the first position and the supply flow path 40 is brought into the closed state by the lever 62 before the liquid discharge apparatus 1 is transported, a pressure variation applied to the ink in the liquid discharge unit 50 can be suppressed to low during the transportation of the liquid discharge apparatus 1, so it is possible to reduce the risk that the ink leaks from the nozzles 51 of the liquid discharge unit 50.

As shown by solid lines in FIG. 8, when the scanner 5 moves from the second position to the first position from a state in which the lever 62 is located closer to the open position than to the middle between the open position and the closed position, the rib 5A interferes with the lever 62 located under the rib 5A. The lever 62 which is located closer to the open position and interferes with the rib 5A is pushed by the scanner 5 moving to the first position and moved so as to be close to the open position. As a result, as shown by two-dot chain lines in FIG. 8, the lever 62, which is located closer to the open position and which is located in the transient position, moves toward the open position. The lever 62 that moves toward the open position easily moves to the position, to which the lever 62 reaches when the lever 62 is opened, by being energized by the energizing member 60C.

As described above, the lever 62 that is manually operated easily stops in the transient position. When the lever 62 is located in the transient position, the pressing member 66 brings the supply flow path 40 into the transient state. When the supply flow path 40 is in the transient state, liquid tends to be supplied at a flow rate smaller than that in the open state. Therefore, when the supply flow path 40 is in the transient state during processing that requires supply of liquid, a sufficient amount of liquid is not supplied. When the supply flow path 40 is in the transient state during processing that requires stopping of supply of liquid, the supply flow path 40 is not located in the closed state, so the liquid leaks out when the liquid discharge apparatus 1 is transported.

In the present embodiment, the interference between the scanner 5 located in the first position that is a normal position and the lever 62 may be a trigger to cause the liquid discharge apparatus 1 or a user to perform processing to avoid the transient state. As a result, it is possible to restrain the supply flow path 40 from continuously being in the transient state. The interference between the lever 62 and the scanner 5 causes the lever 62 to move toward a closer position of the closed position and the open position. Therefore, it is possible to move the lever 62, which is highly possibly to be located in the closed position, close to the closed position, and it is possible to move the lever 62, which is highly possibly to be located in the open position, close to the open position.

For example, when the supply flow path 40 is not completely closed by an operation of the lever 62 by a user, the supply flow path 40 can be brought into the closed state by a user's operation to move the scanner 5 to the first position. When the supply flow path 40 is not completely opened by an operation of the lever 62 by a user, the supply flow path 40 can be brought into the open state by a user's operation to move the scanner 5 to the first position.

The transient position close to the open position and the transient position close to the closed position are ranges different from each other. The transient position close to the open position is a position closer to the open position than the middle between the open position and the closed position. The transient position close to the closed position is a position closer to the closed position than the middle between the open position and the closed position. The middle between the closed position and the open position is a position where the operation angle θ in the middle is one half of the sum of the maximum operation angle and the minimum operation angle.

The middle between the closed position and the open position may be other than a position where the operation angle θ in the transient position is 90°. The middle between the closed position and the open position may be located closer to the open position than to the closed position. The middle between the closed position and the open position may be, for example, a position where a distance between the pressing member 66 and the bottom portion of the recessed portion 68H is one half of that in the open position. The transient position close to the open position and the transient position close to the closed position can be changed according to the shape and size of the lever 62 and/or the shape and size of the cam unit 65.

The transient position close to the closed position, where the lever 62 can be moved to the closed position by the interference with the rib 5A, and the transient position close to the closed position, where movement can be supported by energization of the energizing member 60C, may be ranges equal to each other or may be ranges different from each other. The transient position close to the closed position, where movement can be supported by energization of the energizing member 60C, can be changed by changing a direction of energization of the energizing member 60C.

For example, the operation angle θ in the transient position close to the closed position, where the lever 62 can be moved to the closed position by the interference between the rib 5A and the lever 62, is greater than or equal to 100° and smaller than 140°. On the other hand, the operation angle θ in the transient position close to the closed position, where movement toward the close position can be supported by energization of the energizing member 60C, may be greater than or equal to 85° and smaller than or equal to 120°. In this example, when the operation angle θ is 100° and the scanner 5 moves from the second position to the first position, the interference between the rib 5A and the lever 62 rotates the lever 62 toward the closed position. The rotation of the lever 62 is supported by the energization until the operation angle θ reaches 120°. When the scanner 5 is located in the first position, the lever 62 passes through the transient position and moves until, for example, the operation angle θ reaches 170°. Thereby, the supply flow path 40 transits into the closed state and the lever 62 is prevented from being located in the transient state.

The transient position close to the open position, where the lever 62 can be moved to the open position by the interference with the rib 5A, and the transient position close to the open position, where movement can be supported by energization of the energizing member 60C, may be ranges equal to each other or may be ranges different from each other. The transient position close to the open position, where movement can be supported by energization of the energizing member 60C, can be changed by changing a direction of energization of the energizing member 60C.

For example, the operation angle θ in the transient position close to the open position, where the lever 62 can be moved to the open position by the interference between the rib 5A and the lever 62, is greater than 40° and smaller than or equal to 80°. On the other hand, the operation angle θ in the transient position close to the open position, where movement can be supported by energization of the energizing member 60C, may be greater than or equal to 60° and smaller than 85°.

First Contact Portion and Control Unit

Figure 9:
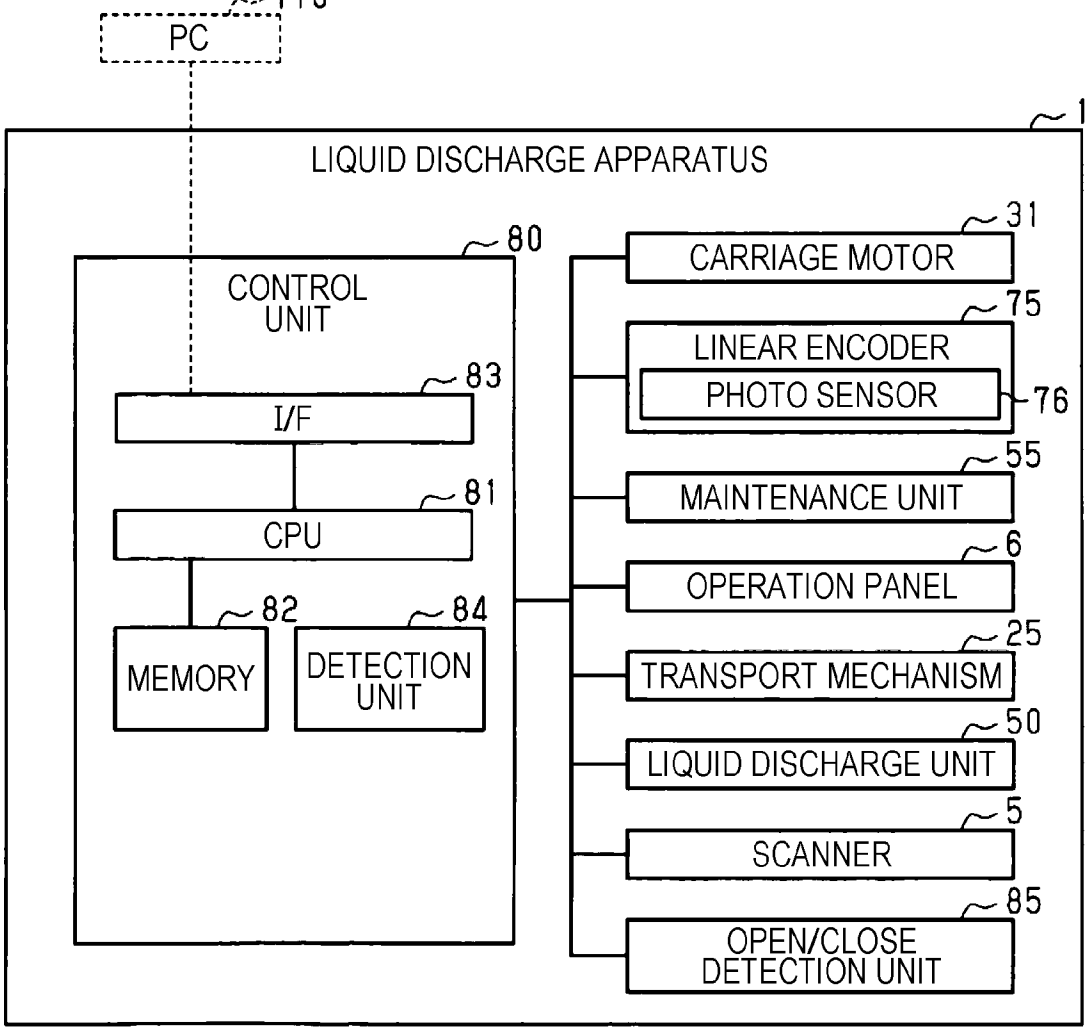
FIG. 9 is a block diagram showing an electrical configuration of the liquid discharge apparatus in the embodiment.
Figure 10:
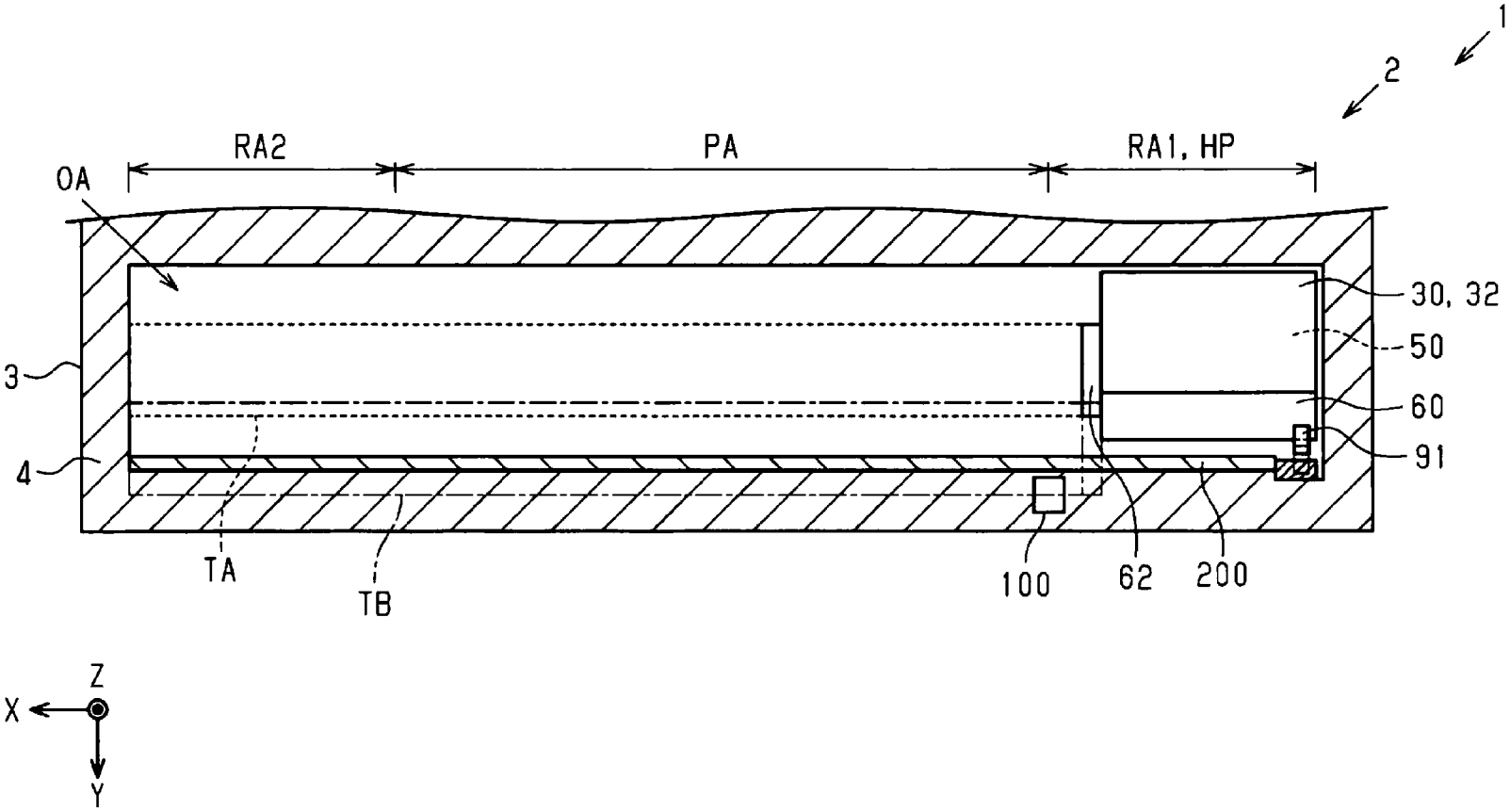
FIG. 10 is a schematic diagram of the liquid discharge apparatus as viewed from above in the embodiment.

A configuration of the first contact portion and the control unit will be described with reference to FIGS. 9 and 10. FIG. 9 is a block diagram showing an electrical configuration of the liquid discharge apparatus 1. FIG. 10 is a schematic diagram of the liquid discharge apparatus 1 as viewed from above in the vertical direction Z.

In FIG. 10, the carriage 30, the opening/closing mechanism 60, the housing 3, and the frame 4 are schematically shown, and the other components are omitted. In FIG. 10, the front surface side in the depth direction Y of the housing 3 is shown, and the back surface side in the depth direction Y of the housing 3 is omitted. In FIG. 10, hatching is applied to the frame 4 that forms a part of the housing 3.

As shown in FIGS. 9 and 10, the carriage 30 can be reciprocated in the width direction X by a driving force applied from a carriage motor 31. A guide shaft (not shown in the drawings) of the carriage motor 31 is provided with a driving pulley not shown in the drawings. A driven pulley (not shown in the drawings) is provided in the apparatus main body 2 at a position spaced from the driving pulley in the width direction X. An endless belt (not shown in the drawings) is wound around the driving pulley and the driven pulley. At least a part of the endless belt grips the carriage 30 at a grip portion (not shown in the drawings) provided at an end portion on the back surface side of the carriage 30. When the carriage motor 31 is driven and rotates, the endless belt rotates in the same direction as the rotation direction of the carriage motor 31 and reciprocates the carriage 30 in the width direction X.

In the housing 3, a linear encoder 75 for detecting the position and speed of the reciprocating carriage 30 in the width direction X is provided. The linear encoder 75 is composed of a linear code plate (not shown in the drawings) which is provided in the housing 3 and is in parallel with the width direction X and a photo sensor 76 which is provided in the carriage 30. A predetermined electrical signal according to a moving state of the carriage 30 is outputted from the photo sensor 76.

As shown in FIG. 10, when the carriage 30 is reciprocated along the guide shaft extending in the width direction X, an area where the carriage 30 moves includes a printing area PA where the liquid discharge unit 50 performs printing and a non-printing area RA where the liquid discharge unit 50 does not perform printing.

The non-printing area RA includes a non-printing area RA1 located on the right side of the printing area PA in the width direction X and a non-printing area RA2 located on the left side of the printing area PA in the width direction X. The printing area PA is arranged between the two non-printing areas RA1 and RA2 in the width direction X.

The non-printing area RA1 is arranged with the home position HP which is a position where the carriage 30 stands by during non-printing. In FIG. 10, the carriage 30 is located at the home position HP.

The carriage 30 can move between a predetermine position and a position other than the predetermined position. The predetermined position is, for example, the home position HP. For example, when the carriage 30 is located at the predetermined position, the carriage 30 is located at the home position HP. When the carriage 30 is located in a position other than the predetermined position, the carriage 30 is located in the printing area PA or the like other than the home position.

In the present embodiment, a maintenance unit 55 that performs maintenance of the liquid discharge unit 50 including cleaning of the nozzles 51 is arranged immediately below the carriage 30 located at the home position HP. For example, the maintenance unit 55 includes a cap (not shown in the drawings) that can be in contact with the liquid discharge unit 50 so as to enclose the nozzles 51 and performs cleaning of the nozzles 51 by depressurizing a space formed by the cap being in contact with the liquid discharge unit 50 and discharging unnecessary ink and bubbles in the nozzles 51.

In the present embodiment, a liquid receiving portion (not shown in the drawings) is provided immediately below the carriage 30 moved to the non-printing area RA2. The liquid receiving portion receives ink discharged from the nozzles 51 by an idle-discharge which is a kind of maintenance. The idle-discharge is to discharge ink not used for printing from the nozzles 51 by driving the piezoelectric elements and eliminate thickening of the ink in the nozzles 51.

Electrical Configuration of Liquid Discharge Apparatus

FIG. 9 is a block diagram showing an electrical configuration of the liquid discharge apparatus 1 according to the present embodiment.

As shown in FIG. 9, the control unit 80 has a CPU (central processing unit) 81, a memory 82, an interface unit (I/F) 83, a detection unit 84, and the like provided on a control board.

The I/F 83 transmits and receives data to and from an external personal computer (PC) 110. A coupling between the PC 110 and the I/F 83 may be uncoupled from a network or may be coupled to the network. The coupling between the PC 110 and the I/F 83 may be wired or may be wireless.

The CPU 81 is an arithmetic processing unit for controlling each drive unit included in the liquid discharge apparatus 1. The memory 82 is a storage element such as a RAM or an EPROM which has an area for storing a program to be executed by the CPU 81 and a work area for executing the program.

The control unit 80 drives the piezoelectric elements included in the liquid discharge unit 50 and causes the plurality of nozzles 51 to discharge ink. The control unit 80 supplies a drive signal to the carriage motor 31 and drives the carriage motor 31.

The photo sensor 76 included in the linear encoder 75 detects position and speed of the carriage 30 that is moved by being driven by the carriage motor 31. The control unit 80 receives a detection signal transmitted from the linear encoder 75. The control unit 80 calculates position and moving speed in the first direction of the carriage 30 by using the detection signal received from the linear encoder 75.

The control unit 80 performs a maintenance operation on the liquid discharge unit 50 by controlling driving of the maintenance unit 55. The control unit 80 receives commands from the operation buttons 8 operated by a user and performs various controls. The control unit 80 drives a transport mechanism 25 and moves a medium in a transport direction crossing the first direction.

The control unit 80 creates print data from image data inputted from the PC 110. The control unit 80 controls driving of the liquid discharge unit 50, the transport mechanism 25, the carriage motor 31, and the like by using the print data and thereby records an image on the medium. The control unit 80 may create print data based on an operation command inputted from the operation panel 6. The PC 110 may be configured to create print data from image data. In this case, the control unit 80 controls driving of the liquid discharge unit 50, the transport mechanism 25, the carriage motor 31, and the like by using print data received from the PC 110.

An open/close detection unit 85 includes an optical sensor or the like and detects whether or not the scanner 5 is in the first position. The control unit 80 receives a detection signal from the open/close detection unit 85. The control unit 80 grasps an open/close state of the scanner 5 by using the detection signal received from the open/close detection unit 85.

The detection unit 84 detects a rotary torque of the carriage motor 31 and continuously monitors whether or not the carriage motor 31 is in an overload state. The control unit 80 moves the carriage 30 mounted with the opening/closing mechanism 60 in the first direction from the home position HP. In this case, the detection unit 84 determines that the carriage motor 31 is in the overload state when a drive load of the carriage motor 31 exceeds a predetermined threshold value stored in the memory 82.

The threshold value stored in the memory 82 is set between a drive load of the carriage motor 31 when the carriage 30 smoothly moves in the width direction X and a drive load of the carriage motor 31 when the movement of the carriage 30 is impeded.

The detection unit 84 may determine that the carriage motor 31 is in the overload state when the drive load of the carriage motor 31 exceeds the threshold value for a certain period of time. The certain period of time is, for example, one second or more. There is a risk that the drive load of the carriage motor 31 suddenly and momentarily increases and exceeds the threshold value. When a case in which the drive load of the carriage motor 31 exceeds a threshold value for a certain period of time is determined to be the over load state, it is possible to eliminate a case in which the drive load suddenly and momentarily increases from a case in which the carriage motor 31 is in the overload state.

In setting processing of each area, the control unit 80 causes the carriage 30 to move in the second direction and come into contact with a side wall of the housing 3. When the carriage 30 comes into contact with the side wall of the housing 3, the carriage 30 is impeded from moving in the second direction. When the carriage 30 is impeded from moving in the second direction, the drive load of the carriage motor 31 increases. The control unit 80 determines that the position of the carriage 30 when the detection unit 84 detects the overload state is a reference position. The control unit 80 sets ranges of the home position HP, the non-printing area RA1, the non-printing area RA2, and the printing area PA in the width direction X by using the reference position.

The home position HP may be set to the position of the carriage 30 when the carriage 30 comes into contact with the side wall of the housing 3 and stops, or may be set to another position to which the carriage 30 moves in the first direction from the position at which the carriage has stopped.

In print processing on a medium, the control unit 80 transports a medium stored in the medium storage unit 22 from upstream to downstream in the transport direction crossing the main scanning direction by driving the transport mechanism 25. The transport mechanism 25 transports the medium to a platen (not shown in the drawings) below the liquid discharge unit 50. The control unit 80 causes the liquid discharge unit 50 to discharge ink by using the print data. Thereby, an image is recorded on a part of the medium facing the liquid discharge unit 50. The control unit 80 ejects the medium on which printing is performed to the medium ejection tray by driving the transport mechanism 25.

Detection Method of Open/Close State of Supply Flow Path

In FIG. 10, the lever 62 in the open position is shown by solid lines, and the lever 62 in the closed position is shown by two-dot chain lines. When the lever 62 is located in the position indicated by the solid lines in FIG. 10, the supply flow path 40 is in the open state, and when the lever 62 is located in the position indicated by the two-dot chain lines in FIG. 10, the supply flow path 40 is in the closed state.

In FIG. 10, a moving area TA in which the lever 62 in the open position moves when the carriage 30 moves from the home position HP to the left side in the width direction X is surrounded by dashed lines. Further, a moving area TB in which the lever 62 in the closed position moves when the carriage 30 moves from the home position HP to the left side in the width direction X is surrounded by dashed-dotted lines.

As shown in FIG. 10, when the lever 62 in the open position shown by solid lines in FIG. 10 rotates by 180° toward the front side of the paper surface, as shown by two-dot chain lines in FIG. 10, the lever 62 moves to the closed position displaced to the front side in the depth direction Y from the open position. On the other hand, when the lever 62 in the closed position shown by two-dot chain lines in FIG. 10 rotates by 180° toward the front side of the paper surface, as shown by solid lines in FIG. 10, the lever 62 moves to the open position displaced to the back side in the depth direction Y from the closed position. In this way, the positions in the depth direction Y of the lever 62 in the open position and the lever 62 in the closed position are different from each other.

A back side end in the depth direction Y of the frame 4 is located on the back side in the depth direction Y of the opening OA. A front side end in the depth direction Y of the frame 4 is located on the front side in the depth direction Y of the opening OA. A range in the depth direction Y of the opening OA is partitioned by the back side end in the depth direction Y of the frame 4 and the front side end in the depth direction Y of the frame 4.

A first contact portion 100 is located on the front side end in the depth direction Y of the frame 4. The first contact portion 100 is provided to the housing 3. In a top view that is viewed from above in the vertical direction Z, the first contact portion 100 is located on the front side in the depth direction Y of the moving area TA. On the other hand, in a top view that is viewed from above in the vertical direction Z, the first contact portion 100 overlaps with the moving area TB in the depth direction Y.

Here, when the lever 62 in the open position moves from the home position HP in the first direction along with the carriage 30, the lever 62 in the open position does not overlap with the first contact portion 100 in the top view. Also in a side view that is viewed from the width direction X, the lever 62 in the open position and the first contact portion 100 are arranged so as not to overlap with each other.

As a result, when the lever 62 in the open position moves from the home position HP in the first direction along with the carriage 30, the lever 62 in the open position and the first contact portion 100 do not interfere with each other in the width direction X. That is, when the lever 62 in the open position moves from the home position HP in the first direction along with the carriage 30, the lever 62 in the open position does not impede the carriage 30 from moving. In other words, when the carriage 30 moves when the supply flow path 40 is in the open state, the lever 62 in the open position does not come into contact with the first contact portion 100.

On the other hand, when the lever 62 in the closed position moves from the home position HP in the first direction along with the carriage 30, the lever 62 in the closed position overlaps with the first contact portion 100 in the top view. Also in a side view that is viewed from the width direction X, the lever 62 in the closed position and the first contact portion 100 are arranged so as to overlap with each other.

As a result, when the lever 62 in the closed position moves from the home position HP in the first direction along with the carriage 30, the lever 62 in the closed position and the first contact portion 100 interfere with each other in the width direction X. That is, when the lever 62 in the closed position moves from the home position HP in the first direction along with the carriage 30, the lever 62 in the closed position impedes the carriage 30 from moving. In other words, when the carriage 30 moves when the supply flow path 40 is in the closed state, the lever 62 in the closed position comes into contact with the first contact portion 100.

Even when the supply flow path 40 is in the closed state, for example, when the operation angle θ is 160° or more, it is preferable that the lever 62 and the first contact portion 100 come into contact with each other. Thereby, even when the supply flow path 40 is in the closed state, the movement of the carriage 30 is impeded on condition that the supply flow path 40 is in a more closed state.

In the present embodiment, for example, a user stops energization of the liquid discharge apparatus 1, changes the position of the lever 62 from the open position to the closed position, and transports the liquid discharge apparatus 1. When the energization of the liquid discharge apparatus 1 is being stopped, the carriage 30 moves to the home position HP and waits. When the transport of the liquid discharge apparatus 1 is completed, the user changes the position of the lever 62 from the closed position to the open position, and starts energization of the liquid discharge apparatus 1. When the energization of the liquid discharge apparatus 1 is started, the control unit 80 moves the carriage 30 located in the home position HP in the first direction.

Here, when the user forgets to change the position of the lever 62 from the closed position to the open position or when an operation to change the position of the lever 62 to the open position is insufficient, if the carriage 30 in the home position HP moves in the first direction, the lever 62 in the closed position comes into contact with the first contact portion 100. As a result, the movement of the carriage 30 is impeded and the drive load of the carriage motor 31 increases. Then, the detection unit 84 detects that the carriage motor 31 is in the overload state, that is, the movement of the carriage 30 is impeded and the first contact portion 100 and the lever 62 are in contact with each other. When the detection unit 84 detects the contact between the lever 62 and the first contact portion 100, the control unit 80 determines that the supply flow path 40 is in the closed state.

When the control unit 80 determines that the supply flow path 40 is in the closed state, the control unit 80 moves the carriage 30 in the second direction. In other words, when the control unit 80 detects that the supply flow path 40 is in the closed state by the movement of the carriage 30 in the first direction, the control unit 80 moves the carriage 30 in the second direction opposite to the first direction and returns the carriage 30 to the home position HP. Regarding the carriage 30 returned to the home position HP, the contact between the lever 62 and the first contact portion 100 is released, and the carriage 30 and the opening/closing mechanism 60 do not receive external force generated by the contact between the lever 62 and the first contact portion 100. As a result, a load of operation for changing the position of the lever 62 from the closed position to the open position is reduced.

When the control unit 80 determines that the supply flow path 40 is in the closed state, the control unit 80 may temporarily stop the drive of the carriage motor 31 so that the external force generated by the contact between the lever 62 and the first contact portion 100 is not excessively applied to the carriage 30 and the opening/closing mechanism 60. The control unit 80 may input a signal for notifying the outside that the supply flow path 40 is in the closed state into the operation panel 6. In this case, the control unit 80 causes the operation panel 6 to display information based on the signal for notifying, that is, for example, an alarm indicating that the supply flow path 40 is in the closed state. The operation panel 6 functions as a notification unit that notifies the outside that the supply flow path 40 is in the closed state.

The notification unit that notifies the outside that the supply flow path 40 is in the closed state is a blinking lamp such as a Patlite (registered trademark), and the notification unit may notify an alarm indicating that the supply flow path 40 is in the closed state by means of light. Alternatively, the notification unit that notifies the outside that the supply flow path 40 is in the closed state is, for example, a buzzer, and the notification unit may notify an alarm indicating that the supply flow path 40 is in the closed state by means of a sound.

When the control unit 80 moves the carriage 30 located in the home position HP in the first direction and the carriage motor 31 does not become the overload state, the control unit 80 determines that the lever 62 and the first contact portion 100 are not in contact with each other and the supply flow path 40 is in the open state.

In this way, when the energization of the liquid discharge apparatus 1 is started, the control unit 80 moves the carriage 30 and determines whether the supply flow path 40 is in the open state or the supply flow path 40 is in the closed state.

The first contact portion 100 is provided at a position which is close to the home position HP in the width direction X in which the carriage 30 moves and which is located on the right side in the width direction X of the frame 4. The opening/closing mechanism 60 is provided on the left side in the width direction X in the carriage 30. Therefore, when the supply flow path 40 is in the closed state, it is possible to quickly detect the contact between the first contact portion 100 and the lever 62. Therefore, it is possible to improve throughput of the detection operation of the open/close state of the supply flow path 40.

The moving speed of the carriage 30 when the open/close state of the supply flow path 40 is detected may be set slower than the moving speed of the carriage 30 when printing is performed. Thereby, it is possible to restrain the lever 62 and the first contact portion 100 from receiving a large impact when the first contact portion 100 and the lever 62 come into contact with each other, and thereby it is possible to restrain the first contact portion 100 from being deformed.

The timing when the control unit 80 detects the open/close state of the supply flow path 40 will be described.

The timing when the control unit 80 detects the open/close state of the supply flow path 40 may be in a period from when the liquid discharge apparatus 1 is energized to when ink is first discharged from the nozzles 51.

Specifically, the timing may be in any one of periods from when the liquid discharge apparatus 1 is energized to when the liquid discharge unit 50 performs the first idle-discharge, from when the liquid discharge apparatus 1 is energized to when the first cleaning is performed, and from when the liquid discharge apparatus 1 is energized to when the ink is discharged for the first printing. Further, in any one of the above timings, the open/close state of the supply flow path 40 may be detected when the carriage 30 first moves in the first direction after the liquid discharge apparatus 1 is energized.

Other timings when the control unit 80 detects the open/close state of the supply flow path 40 will be described.

When the liquid discharge apparatus 1 is energized, the open/close detection unit 85 detects an open/close operation of the scanner 5. When the scanner 5 is in the second position, the lever 62 is easily operated by a user. There is a risk that the scanner 5 is arranged in the first position in a state in which the supply flow path 40 is brought into the closed state.

Therefore, the timing when the control unit 80 detects the open/close state of the supply flow path 40 is desired to be in a period from when the open/close operation in which the scanner 5 is opened once and closed is performed to when the ink is first discharged from the nozzles 51 after the open/close operation in a state in which the liquid discharge apparatus 1 is energized.

Specifically, in a state in which the liquid discharge apparatus 1 is energized, the timing may be in any one of periods from when the open/close operation of the scanner 5 is performed to when the first idle-discharge is performed after the open/close operation, from when the open/close operation of the scanner 5 is performed to when the ink is discharged by the first cleaning after the open/close operation, and from when the open/close operation of the scanner 5 is performed to when the ink for the first printing after the open/close operation is discharged. By performing the detection operation of the open/close state of the supply flow path 40 at such timing, It is possible to restrain a user from starting printing while the supply flow path 40 is closed.

As described above, the control unit 80 can detect the open/close state of the supply flow path 40 by the contact between the opening/closing mechanism 60 and the first contact portion 100. Such detection becomes a chance to perform processing to stop movement of the carriage 30 or processing to inform a user to bring the supply flow path 40 into the open state. Therefore, a risk that a user forgets to bring the supply flow path 40 into the open state is restrained, so that it is possible to restrain printing from being performed while the supply flow path 40 is in the closed state.

The opening/closing mechanism 60, the housing 3, the carriage 30, the control unit 80, and the operation panel 6, which are components for detecting the open/close state of the supply flow path 40, are components for the liquid discharge apparatus 1 to perform printing on a medium. The open/close state of the supply flow path 40 is detected by utilizing the components for the liquid discharge apparatus 1 to perform printing on a medium. Therefore, new components are not required to detect the open/close state of the supply flow path 40, so that it is possible to reduce the cost of the liquid discharge apparatus 1 as compared with a case in which new components for detecting the open/close state of the supply flow path 40 are required.

Configuration of Restricting Portion

Figure 11:
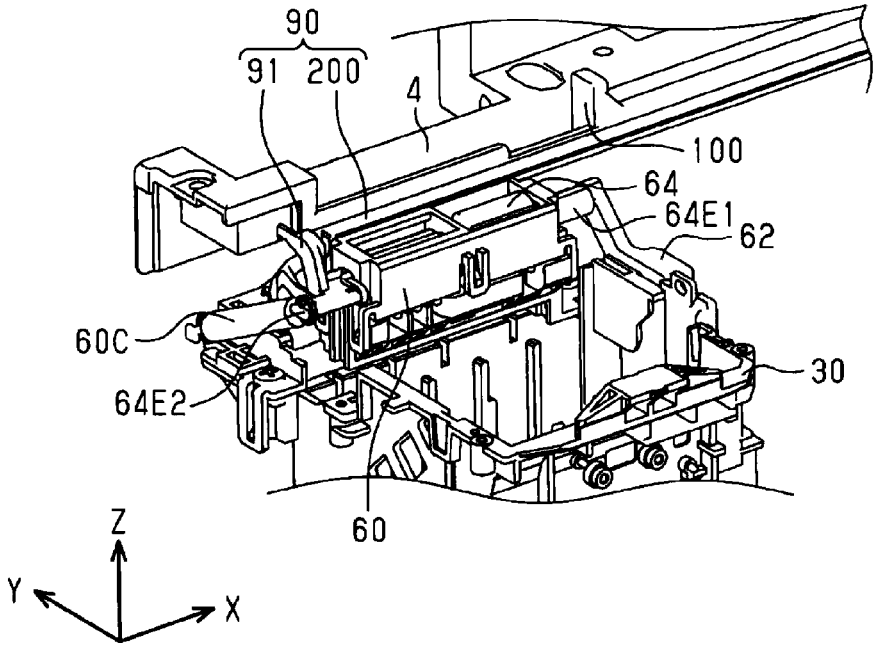
FIG. 11 is a perspective view when a displacement portion is located in an allowed area in the embodiment.
Figure 12:
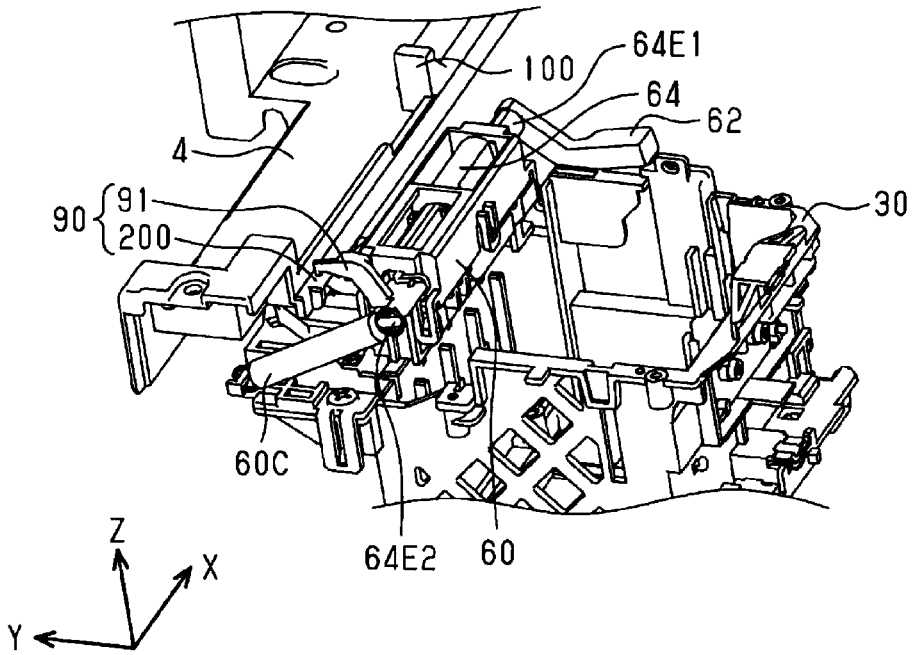
FIG. 12 is a perspective view when the displacement portion is located in a restricted area in the embodiment.

The restricting portion will be described with reference to FIGS. 11 and 12. FIG. 11 is a perspective view when a displacement portion 91 included in a restricting portion 90 is located in an allowed area. FIG. 12 is a perspective view when the displacement portion 91 included in the restricting portion 90 is located in a restricted area.

As shown in FIGS. 11 and 12, the liquid discharge apparatus 1 includes the restricting portion 90 that restricts the movement of the lever 62. The restricting portion 90 includes the displacement portion 91 that is displaced interlocking with the lever 62 and a second contact portion 200 provided to the housing 3.

As shown in FIG. 11, the displacement portion 91 is integrated with the end portion 64E2 of the shaft unit 64. The displacement portion 91 has a projecting piece shape extending from the end portion 64E2 in the radial direction of the shaft unit 64. The displacement portion 91 can rotate around the rotation axis A. The displacement portion 91 rotates interlocking with the rotation of the lever 62 through the rotation of the shaft unit 64. In the present embodiment, when the lever 62 is in the open position, the tip of the displacement portion 91 faces the front side. When the lever 62 moves from the open position to the closed position, the displacement portion 91 rotates so that the tip of the displacement portion 91 faces down.

The second contact portion 200 is a part of the housing 3 and has a plate shape extending along the width direction X. The second contact portion 200 is located in a part in the width direction X of the housing 3. The second contact portion 200 overlaps with a locus where the displacement portion 91 rotates as viewed from the width direction X.

In a movable range of the carriage 30, a range where the displacement portion 91 and the second contact portion 200 face each other in the vertical direction Z is the restricted area. In the movable range of the carriage 30, a range where the displacement portion 91 and the second contact portion 200 do not face each other in the vertical direction Z is the allowed area. The displacement portion 91 moves to the allowed area and the restricted area along with the movement of the carriage 30. The allowed area in the present embodiment is the home position HP, and the restricted area is the non-printing area RA2 and the printing area PA other than the home position HP.

In FIG. 11, the lever 62 is located in the open position and the carriage 30 is located in the allowed area. In FIG. 12, the lever 62 is located in the open position and the carriage 30 is located in the restricted area.

Here, when the lever 62 rotates when the carriage 30 is located in the allowed area, the displacement portion 91 and the second contact portion 200 do not come into contact with each other and the displacement portion 91 rotates interlocking with the rotation of the lever 62. That is, the second contact portion 200 allows the lever 62 to move between the open position and the closed position.

On the other hand, as shown in FIG. 12, when the lever 62 rotates when the carriage 30 is located in the restricted area, the tip of the displacement portion 91 comes into contact with the second contact portion 200 from above and the rotation of the lever 62 stops because the rotation of the displacement portion 91 stops. That is, the second contact portion 200 restricts the lever 62 from moving from the open position to the closed position.

It is necessary to move the carriage 30 to the home position HP to move the lever 62 to the open position. Thereby, when the carriage 30 is located in a printable position, by moving the lever 62 to the closed position, it is possible to restrain the supply flow path 40 from being brought into the closed state. Therefore, for example, it is possible to avoid a situation where printing is performed regardless that the supply flow path 40 is closed and ink is not supplied to a head.

On the assumption that the supply flow path 40 is brought into the closed state, it is urged that the carriage 30 is moved to the home position HP. For example, an operation to bring the supply flow path 40 into the closed state is performed in processing including arranging the carriage 30 to the home position HP, such as inspection, repair, and shipment of the liquid discharge apparatus 1. When the carriage 30 is located other than the home position HP, an operation to bring the supply flow path 40 into the closed state is restricted. Therefore, in processing including an operation to bring the supply flow path 40 into the closed state, it is urged that the carriage 30 is moved to the home position HP suitable for the processing.

Hereinafter, effects exerted by the liquid discharge apparatus 1 according to the present embodiment will be described.

(1) The interference between the scanner 5 and the operation unit 60B causes the supply flow path 40 to retreat from the transient state. The interference between the scanner 5 and the operation unit 60B may be a trigger to cause the liquid discharge apparatus 1 or a user to perform processing to avoid the transient state. As a result, it is possible to restrain the supply flow path 40 from continuously being in the transient state.

(2) The interference between the scanner 5 and the operation unit 60B causes the operation unit 60B to move to a closer position of the closed position and the open position. Therefore, it is possible to move the operation unit 60B, which is highly possibly to be located in the closed position, close to the closed position, and it is possible to move the operation unit 60B, which is highly possibly to be located in the open position, close to the open position. In other words, it is possible to move a position of the operation unit 60B that brings the supply flow path 40 into the transient state toward a position where the operation unit 60B is highly probably located originally.

(3) It is possible to restrain the operation unit 60B from stopping in the transient position by energization. Further, it is possible to restrain supply of ink that is supplied because the operation unit 60B that should be located in the closed position stops in the transient position, that is, it is possible to restrain consumption of ink that is not intended by a user.

(4) The detection of the contact between the opening/closing mechanism 60 and the first contact portion 100 may be, for example, a trigger to stop the movement of the carriage 30 or a trigger to bring the supply flow path 40 into the open state. As a result, it is possible to restrain generation of inconsistency between the state of the supply flow path 40 and the state of the carriage 30.

(5) When the carriage 30 is located other than the home position HP, an operation to bring the supply flow path 40 into the closed state is restricted. Therefore, as an assumption to bring the supply flow path 40 into the closed state, it is urged that the carriage 30 is moved to the home position HP. In other words, in processing including an operation to bring the supply flow path 40 into the closed state, it is urged that the carriage 30 is moved to the home position HP suitable for the processing.

(6) The displacement portion 91 is displaced interlocking with the operation unit 60B, and the displacement portion 91 restricts the movement of the operation unit 60B in a direction in which the supply flow path 40 is brought into the closed state. Therefore, it is possible to restrain an operation of a user from being troublesome as compared with a case where a displacement portion 91 that does not interlock with the operation unit 60B is separately provided.

(7) The housing 3 includes the first contact portion 100 and the second contact portion 200, so that it is possible to reduce the number of components as compared with a case where the first contact portion 100 and the second contact portion 200 are provided separately from the housing 3.

(8) Even when the lever 62 is located in a position where the lever 62 brings the supply flow path 40 into the transient state, the supply flow path 40 can be brought into either one of the open state or the closed state by a normal operation to cause the scanner 5 to move to the first position.

The present embodiment can be implemented by changing the embodiment as described below. The present embodiment and modified examples described below can be implemented by combining them together to the extent where there is no technical contradiction.

It is possible to configure so that the carriage 30 includes the first contact portion 100 and the opening/closing mechanism 60 is fixed to the housing 3. In this configuration, the first contact portion 100 moves along with the carriage 30. The operation unit 60B included in the opening/closing mechanism 60 stops continuously along with the housing 3. Then, the operation unit 60B that brings the supply flow path 40 into the closed state comes into contact with the first contact portion 100 that moves along with the carriage 30.

The first contact portion 100 can be changed into a cushioning member that can alleviate an impact generated when the first contact portion 100 comes into contact with the lever 62.

The displacement portion 91 may be integrated with an end portion 64E1 of the shaft unit 64 or may be a member different from the shaft unit 64.

The moving unit may be a printer cover, a carriage cover, the operation panel 6, an ink inlet cover, and the like.

The liquid discharge apparatus 1 may be a cartridge type or an Ink injection type as long as it is an off-carriage type.

The moving unit may be configured so as to be able to drive a transmission mechanism different from the operation unit 60B, and the moving unit may move the operation unit 60B by a driving force transmitted by the transmission mechanism.

The opening/closing mechanism 60 may be provided to, for example, an ink tank, a cartridge holder, the housing 3, the frame 4, and the like.

The displacement portion 91 may be integrated with the operation unit 60B or may be a body separate from the operation unit 60B.

The first contact portion 100 and the second contact portion 200 may composed of a member different from the housing 3. The member different from the housing 3 is, for example, a member attached to the housing 3, the frame 4, and the like.

The lever 62 may include only the base portion 62A without including the tip portion 62B. In a configuration where the lever 62 does not include the tip portion 62B, the rib 5A of the scanner 5 and the base portion 62A of the lever 62 interfere with each other.

The first contact portion 100 and the second contact portion 200 need not be provided in the housing 3. When the first contact portion 100 and the second contact portion 200 are provided in the housing 3, it is possible to reduce the number of components as compared with a case where the first contact portion 100 and the second contact portion 200 are provided separately from the housing 3, so that it is possible to suppress the cost of the liquid discharge apparatus 1.

Hereinafter, technical ideas grasped from the embodiment and the modified examples described above and its operational effects will be described.

Idea 1: An liquid discharge apparatus includes a liquid storing portion that stores liquid, a liquid discharge unit that discharges the liquid to a medium and performs printing, a supply flow path that communicates the liquid storing portion and the liquid discharge unit, an opening/closing mechanism including an opening/closing unit that brings the supply flow path into an open state or a closed state and an operation unit that operates the opening/closing unit, and a moving unit configured to move between a first position that is a normal position when performing printing and a second position different from the first position. A range where the operation unit brings the supply flow path into a transient state between the open state and the closed state includes a position of the operation unit at which the operation unit interferes with the moving unit located in the first position.

According to the Idea 1, when the operation unit interferes with the moving unit located in the first position, the operation unit brings the supply flow path into the transient state. An interference between the moving unit located in a normal position and the operation unit may be a trigger to cause the liquid discharge apparatus or a user to perform processing to avoid the transient state. As a result, it is possible to restrain the supply flow path from continuously being in the transient state.

Idea 2: In the liquid discharge apparatus, the operation unit can move between an open position where the supply flow path is brought into the open state and a closed position where the supply flow path is brought into the closed state, and the moving unit may move the operation unit in a direction approaching the closed position by interfering with the operation unit when the operation unit is located closer to the closed position than to the middle between the open position and the closed position and may move the operation unit in a direction approaching the open position by interfering with the operation unit when the operation unit is located closer to the open position than to the middle between the open position and the closed position.

According to the Idea 2, the operation unit interferes with the moving unit and thereby the operation unit moves to a closer position of the closed position and the open position. Therefore, it is possible to move the operation unit, which is highly possibly to be located in the closed position, close to the closed position, and it is possible to move the operation unit, which is highly possibly to be located in the open position, close to the open position. In other words, it is possible to move a position of the operation unit that brings the supply flow path into the transient state toward a position where the operation unit is highly probably located originally.

Idea 3: In the liquid discharge apparatus, the opening/closing mechanism may further include an urging member that urges the operation unit in a direction in which the supply flow path is brought into the closed state.

According to the Idea 3, it is possible to restrain the operation unit from stopping in the transient position between the open position and the closed position by energization. Further, it is possible to restrain supply of liquid that is supplied because the operation unit that should be located in the closed position stops in the transient position, that is, it is possible to restrain consumption of liquid that is not intended by a user.

Idea 4: The liquid discharge apparatus may further include a carriage which is mounted with the liquid discharge unit and the opening/closing mechanism and which can reciprocate in a first direction and a second direction opposite to the first direction, a first contact portion that comes into contact with the opening/closing mechanism when the carriage is moved while the supply flow path is in the closed state, and a detection unit that detects a contact between the opening/closing mechanism and the first contact portion.

According to the Idea 4, it is possible to detect that the opening/closing mechanism comes into contact with the first contact portion when the carriage is moved while the supply flow path is in the closed state. The detection of the contact between the opening/closing mechanism and the first contact portion may be, for example, a trigger to stop the movement of the carriage or a trigger to bring the supply flow path into the open state. As a result, it is possible to restrain generation of inconsistency between the state of the supply flow path and the state of the carriage.

Idea 5: The liquid discharge apparatus may further include a restricting portion that restricts movement of the operation unit in a direction in which the supply flow path is brought from the open state into the closed state when the carriage is located in a position other than a predetermined position.

The operation in which the supply flow path is brought into the closed state is, for example, inspection, repair, shipment, or the like of the liquid discharge apparatus, and the operation is performed in processing including arranging the carriage to a predetermined position. According to the Idea 5, when the carriage is located in a position other than the predetermined position, the operation in which the supply flow path is brought into the closed state is restricted. Therefore, as an assumption to bring the supply flow path into the closed state, it is urged that the carriage is moved to the predetermined position. In other words, in processing including an operation to bring the supply flow path into the closed state, it is urged that the carriage is moved to a predetermined position suitable for the processing.

Idea 6: In the liquid discharge apparatus, the restricting portion may include a displacement portion and a second contact portion, and the displacement portion is provided on a movement locus of the displacement portion in a case where the carriage is located in a position other than the predetermined position and restricts movement of the operation unit by coming into contact with the displacement portion when the operation unit moves in a direction in which the supply flow path is brought into the closed state.

According to the Idea 6, when the carriage is located in a position other than the predetermined position, the displacement portion is displaced interlocking with the operation unit and the displacement portion restricts the movement of the operation unit in a direction in which the supply flow path is brought into the closed state. Therefore, it is possible to more restrain an operation of a user from being troublesome as compared with a case where a restricting portion that does not interlock with the operation unit is separately provided.

Idea 7: In the liquid discharge apparatus, the first contact portion and the second contact portion may be provided in a housing that houses the liquid discharge unit and the carriage.

According to the Idea 7, it is possible to reduce the number of components as compared with a case where the first contact portion and the second contact portion are provided separately from the housing, so that it is possible to suppress the cost of the liquid discharge apparatus.

Idea 8: In the liquid discharge apparatus, the operation unit may include a lever that can rotate between an open position where the supply flow path is brought into the open state and a closed position where the supply flow path is brought into the closed state, the opening/closing unit may have a pressing member that brings the supply flow path into the closed state when the lever is located in the closed position and brings the supply flow path into the open state when the lever is located in the open position, and the moving unit may move the lever in a direction approaching the closed position when the lever is located closer to the closed position than to the middle between the open position and the closed position and may move the lever in a direction approaching the open position when the lever is located closer to the open position than to the middle between the open position and the closed position.

According to the Idea 8, even when the lever is located in a position where the lever brings the supply flow path into the transient state, it is possible to move the lever close to either one of the closed position and the open position by the moving unit.

What is claimed is:

1. A liquid discharge apparatus comprising:

a liquid storing portion that stores liquid;

a liquid discharge unit that discharges the liquid to a medium and performs printing;

a supply flow path that communicates the liquid storing portion and the liquid discharge unit;

an opening/closing mechanism including an opening/closing unit that brings the supply flow path into an open state or a closed state, an operation unit that operates the opening/closing unit, and an urging member that urges the operation unit; and a moving unit configured to move between a first position that is a normal position when performing the printing and a second position different from the first position, wherein a range where the operation unit brings the supply flow path into a transient state between the open state and the closed state includes a position of the operation unit at which the operation unit interferes with the moving unit located in the first position.

2. The liquid discharge apparatus according to claim 1, wherein the operation unit is configured to move between an open position where the supply flow path is brought into the open state and a closed position where the supply flow path is brought into the closed state, and the moving unit moves the operation unit in a direction approaching the closed position by interfering with the operation unit when the operation unit is located closer to the closed position than to the middle between the open position and the closed position and moves the operation unit in a direction approaching the open position by interfering with the operation unit when the operation unit is located closer to the open position than to the middle between the open position and the closed position.

3. The liquid discharge apparatus according to claim 1, wherein the urging member urges the operation unit in a direction in which the supply flow path is brought into the closed state.

4. The liquid discharge apparatus according to claim 1, further comprising:

a carriage which is mounted with the liquid discharge unit and the opening/closing mechanism and which is configured to reciprocate in a first direction and a second direction opposite to the first direction;

a first contact portion that comes into contact with the opening/closing mechanism when the carriage is moved while the supply flow path is in the closed state; and a detection unit that detects a contact between the opening/closing mechanism and the first contact portion.

5. The liquid discharge apparatus according to claim 4, further comprising:

a restricting portion that restricts movement of the operation unit in a direction in which the supply flow path is brought from the open state into the closed state when the carriage is located in a position other than a predetermined position.

6. The liquid discharge apparatus according to claim 5, wherein the restricting portion includes a displacement portion and a second contact portion, and the displacement portion is provided on a movement locus of the displacement portion in a case where the carriage is located in a position other than the predetermined position and restricts movement of the operation unit by coming into contact with the displacement portion when the operation unit moves in a direction in which the supply flow path is brought into the closed state.

7. The liquid discharge apparatus according to claim 6, wherein the first contact portion and the second contact portion are provided in a housing that houses the liquid discharge unit and the carriage.

8. The liquid discharge apparatus according to claim 1, wherein the operation unit includes a lever configured to rotate between an open position where the supply flow path is brought into the open state and a closed position where the supply flow path is brought into the closed state, the opening/closing unit has a pressing member that brings the supply flow path into the closed state when the lever is located in the closed position and brings the supply flow path into the open state when the lever is located in the open position, and the moving unit moves the lever in a direction approaching the closed position when the lever is located closer to the closed position than to the middle between the open position and the closed position and moves the lever in a direction approaching the open position when the lever is located closer to the open position than to the middle between the open position and the closed position.

9. A liquid discharge apparatus comprising:

a liquid storing portion that stores liquid;

a liquid discharge unit that discharges the liquid to a medium and performs printing;

a supply flow path that communicates the liquid storing portion and the liquid discharge unit;

an opening/closing mechanism including an opening/closing unit that brings the supply flow path into an open state or a closed state and an operation unit that operates the opening/closing unit;

a moving unit configured to move between a first position that is a normal position when performing the printing and a second position different from the first position; and a carriage which is mounted with the liquid discharge unit and the opening/closing mechanism and which is configured to reciprocate in a first direction and a second direction opposite to the first direction;

a first contact portion that comes into contact with the opening/closing mechanism when the carriage is moved while the supply flow path is in the closed state; and a detection unit that detects a contact between the opening/closing mechanism and the first contact portion, wherein a range where the operation unit brings the supply flow path into a transient state between the open state and the closed state includes a position of the operation unit at which the operation unit interferes with the moving unit located in the first position.

10. A liquid discharge apparatus comprising:

a liquid storing portion that stores liquid;

a liquid discharge unit that discharges the liquid to a medium and performs printing;

a supply flow path that communicates the liquid storing portion and the liquid discharge unit;

an opening/closing mechanism including an opening/closing unit that brings the supply flow path into an open state or a closed state and an operation unit that operates the opening/closing unit; and a moving unit configured to move between a first position that is a normal position when performing the printing and a second position different from the first position, wherein the operation unit includes a lever configured to rotate between an open position where the supply flow path is brought into the open state and a closed position where the supply flow path is brought into the closed state, the opening/closing unit has a pressing member that brings the supply flow path into the closed state when the lever is located in the closed position and brings the supply flow path into the open state when the lever is located in the open position, the moving unit moves the lever in a direction approaching the closed position when the lever is located closer to the closed position than to the middle between the open position and the closed position and moves the lever in a direction approaching the open position when the lever is located closer to the open position than to the middle between the open position and the closed position, and a range where the operation unit brings the supply flow path into a transient state between the open state and the closed state includes a position of the operation unit at which the operation unit interferes with the moving unit located in the first position.

* * * * *